US005105948A

United States Patent [19]

Morris et al.

[11] Patent Number: 5,105,948

[45] Date of Patent: Apr. 21, 1992

[54] STACKABLE AND NESTABLE BEVERAGE CAN TRAY

[75] Inventors: Peter M. Morris, Wareton; Robert C. Allabaugh, Barnegat, both of N.J.

[73] Assignee: Piper Casepro, Manasquan, N.J.

[21] Appl. No.: 647,349

[22] Filed: Jan. 29, 1991

Related U.S. Application Data

[63] Continuation-in-part of Ser. No. 476,883, Feb. 8, 1990, Pat. No. 5,031,774.

[51] Int. Cl.[5] ..... B65D 21/02; B65D 85/62

[52] U.S. Cl. ..... 206/519; 206/427; 206/504; 206/518; 206/564; 220/519; 217/26.5

[58] Field of Search ..... 206/427, 503, 509, 518, 206/519, 557, 558, 564, 565; 217/26.5; 220/519

[56] References Cited

U.S. PATENT DOCUMENTS

| | | | |
|---|---|---|---|
| 3,765,592 | 10/1973 | Chadbourne | 217/26.5 |
| 3,826,229 | 7/1974 | Classe | 206/519 |
| 3,967,747 | 7/1975 | Wagner | 206/519 |
| 4,098,403 | 7/1978 | Davis | 206/519 |
| 4,410,099 | 10/1983 | de Larosiere | 206/427 |
| 4,548,320 | 10/1985 | Box | 206/427 |
| 4,615,443 | 10/1986 | Deffner | 206/427 |
| 4,615,444 | 10/1986 | de Larosiere | 206/427 |
| 4,834,243 | 5/1989 | Langenbeck | 206/427 |
| 4,896,774 | 1/1990 | Hammett | 206/518 |
| 4,932,532 | 6/1990 | Apps et al. | 206/503 |

FOREIGN PATENT DOCUMENTS 1152038 5/1969 United Kingdom .

*Primary Examiner*—Joseph Man-Fu Moy

*Attorney, Agent, or Firm*—Mason, Fenwick & Lawrence

[57] ABSTRACT

A molded, stackable and nestable beverage can tray having tapered side walls and end walls, contoured window openings in both the side walls and end walls, and having contoured window openings in both side walls and end walls to snugly contain the cans is disclosed. The bottom length and width dimensions of the tray are less than the sum of the diameters of rows of can placed in the tray. Trays according to the invention have 3:2 length-to-width ratio for cross-tying stacks, and have a tray bottom design having generally diamond-shaped standoffs projecting downwardly from the bottom of the tray to lock onto the tops of the cans contained in the tray immediately beneath the can tray. The trays include can bottom seating rings capable of receiving and centering cans having a range of the bottom diameter dimensions. Trays according to the invention have side walls and end walls which are tapered at an angle of preferably 10°, thereby enabling the trays to be nested to at least 67% of their overall height when stacked in an empty condition. In a second preferred embodiment of the invention, the tray bottom is molded with additional downwardly extending arcuate ribs to provide greater tray bottom exterior surface area. This second tray embodiment further includes upper end side openings in an upturned peripheral top lip for manually separating nested empty trays and to enable automatic can tray packing apparatus to feed a nested stack of empty trays onto a conveyor.

35 Claims, 14 Drawing Sheets

STACKABLE AND NESTABLE BEVERAGE CAN TRAY

RELATED APPLICATION CROSS-REFERENCE

This is a continuation-in-part of applicants' copending application Ser. No. 07/476,883, filed Feb. 8, 1990 now U.S. Pat. No. 5,031,774. The subject matter of this invention is also related to that of U.S. Design Pat. application Ser. No. 07/441,155, filed Nov. 22, 1989.

FIELD OF THE INVENTION

The present invention relates to molded packaging trays (1) capable of being loaded with a plurality of beverage containers, (2) capable of being stacked when loaded with other similar trays one above the other, and (3) capable of being stacked when empty with one tray nested within another. The present invention relates more specifically to stackable, nestable packaging trays which may be nested one within another when the trays are empty, and which may be stacked in a variety of interlocking arrangements when loaded with beverage cans or similar containers or items.

BACKGROUND OF THE INVENTION

Packaging trays molded of thermoplastics, paper pulp and similar materials are widely used to support, organize and stabilize loads of relatively fragile, easily disordered goods, such as beverage cans. In the beverage can filling industry, beverages are generally loaded and transported in 24-can case loads. Since the time between bottling or canning and delivery to the customer is relatively brief, and because the cans employed fully contain the beverage, it is common industry practice not to enclose or seal case loads in packaging such as crates or cardboard boxes. Rather, the filled cans are typically placed in case loads on rectangular corrugated cardboard shipping trays in rows of six cans and four cans respectively parallel to the longest and shortest dimensions of the tray. The loaded shipping trays are stacked in an interlocked arrangement atop a wooden pallet. Corrugated cardboard shipping trays conventionally used include a cardboard bottom and four short vertical sides approximately two inches in height. When the conventional trays are loaded with filled beverage cans, the weight of the cans compresses the cardboard bottom, producing circular impressions formed by the can in the cardboard beneath each can bottom. These impressions help reduce movement of the cans during sudden lateral movement of the tray.

In a typical cross-tied arrangement, loaded trays are placed on a pallet such that adjacent trays are oriented at a 90° angle to one another, rather than being placed in parallel rows. Further, trays are placed such that they are oriented at a 90° angle with respect to subjacent trays. The entire cross-tied "palletized" load then is moved using a forklift and loaded onto a truck for delivery to the final destination.

However, beverage can packaging trays in the prior art have not provided adequate stability for the palletized load. Conventional, non-interlocking trays are stabilized atop a pallet only by the combined weight of the beverage cans and trays. Accordingly, there is great risk that the loaded trays may shift in transit, or that individual cans may be dented, scratched or have their labels blemished by can vibrations and consequently rendered in unsalable or unattractive condition. Further, palletized stacks of conventional, loaded can trays must be wrapped with strong, plastic stretch wrap or other material to prevent lateral shifting of the palletized load in transit.

It is also desirable that empty packaging trays be capable of nested storage to reduce space occupied in a warehouse, store or truck while awaiting return to the bottler for subsequent reuse. However, packaging trays in the prior art have been either not capable of nesting at all, or capable of nesting only to a limited depth; thus, such prior art trays occupy a large volume of storage space. Empty can trays also should be readily usable by automatic can packing equipment in loading cans onto such trays.

Attempts to produce interlocking can shipment trays to circumvent these disadvantages have not solved all of the problems presented above. For example, U.S. Pat. No. 3,949,876 (Bridges et al) teaches the use of a tray for serving beverages having depressions on its upper surface for receiving the bottoms of insulated tumblers or mugs, and having recesses formed in its bottom surface to receive the tops of tumblers or mugs in a stack below. However, the trays described by Bridges do not permit interlocked, cross-tied stacking, and therefore do not substantially increase the stability of a highly stacked load. Similarly, U.S. Pat. No. 3,651,976 (Chadbourne) discloses a nestable, interlocking packaging tray for a variety of goods which permits multi level stacking, with alternate trays oriented differently from adjacent ones. However, the tray described by Chadbourne makes no provision for assuring the stability of goods placed within the tray.

This last-mentioned disadvantage was partially circumvented by U.S. Pat. No. 3,349,943 (Box), which discloses a bottle carrying and stacking case having a plurality of recesses molded into the bottom of the case for receiving and interlocking with the tops of bottles carried in a case below. The Box disclosure also provides highwalled separate storage compartments for each bottle, but the case described by Box does not permit efficient, nested stacking of empty cases.

Likewise, U.S. Pat. No. 4,625,908 (Emery) provides a closed-bottle packaging container having molded restraints for preventing lateral motion of bottles in the container, but the container may not be nested. Further, U.S. Pat. No. 3,891,084 (Aleizondo-Garcia) provides a basket for carrying bottles having contoured carrying compartments, but the basket is not designed for interlocked stacking and nesting. It is also desirable that beverage can packaging trays be lightweight to facilitate easy return to the bottler. Prior art trays are made of corrugated cardboard, a material which is inherently lightweight. Molded plastic trays are considerably heavier, but general concepts for reducing their weight are well known in the prior art. For example, U.S. Pat. No. 3,794,208 (Roush et al) shows a packaging tray having a gridwork bottom which reduces weight by reducing the amount of plastic required to form the tray bottom. However, the Roush disclosure does not provide for efficient cross-tied stacking or nesting of trays.

To achieve the desired goal of deeply nestable trays, the present invention provides angled sides having a plurality of contoured cut-out windows in the tray sides which permit cans placed in the tray to extend beyond a plane perpendicular to the bottom of the tray. The use of such contoured windows to provide clearance space for beverage containers is shown in the Aleizondo-Garcia patent which discloses a beverage bottle carrying basket having similar contoured windows set in to tapered side walls. However, the Aleizondo-Garcia invention is unsuitable for cross-tied interlocked shipment of can case loads.

Further, the use of contoured window cut-outs in the base of a beverage container carrier is described in U.S. Pat. No. 3,186,587 (Englander et al). However, the window cutouts in the Englander disclosure do not contribute to efficient nesting of the container carriers, but merely enhance the structural strength of the paperboard carrier described. Therefore, persons in the beverage canning, bottling and packaging industry would find it desirable to have a beverage can packaging tray capable of efficient nesting when empty and of use by automatic can tray loading equipment, and capable of sturdy, interlocked, stacked arrangements when the tray is fully loaded. This present invention meets this need.

SUMMARY OF THE PRESENT INVENTION

Accordingly, it is the primary object of the present invention to provide a new and improved beverage can tray.

A further object of the present invention is to provide a stackable and nestable beverage can tray having tapered, contour-windowed, side and end walls to snugly contain and support cans such that the length and width dimensions of the bottom tray portion are less than the sum total, measured lengthwise and widthwise, of the diameters of rows of cans.

It is another object of the invention to provide a unique beverage can packaging tray having a 3:2 length-to-width ratio to readily facilitate cross-tying stacks during transit, which ratio further ensures that all cross-tied stack arrangements palletize with no overhang between tiers with an absolute minimum of overhang on most pallet sizes.

It is a further object of the present invention to provide an improved stackable and nestable beverage can tray having a bottom molded with recesses to receive tops of cans loaded in a subjacent tray and interior molded can support wells which limit lateral motion of the cans such that a palletized load comprising a plurality of loaded, cross-tied, interlocked stacks of trays is sufficiently stable to preclude the need for using stretch-wrap or other restraint on the load.

It is yet another object of the present invention to provide an improved stackable and nestable beverage can tray having tapered walls molded at an angle sufficient to permit nesting of stacked empty trays to a depth of a substantial portion of their overall height.

It is still a further object of the present invention to provide an improved stackable, nestable beverage can tray having contoured cut-out windows to permit the lower ends of beverage cans placed in the tray to extend outwardly beyond the bottom periphery of the tray.

An additional object of a second preferred embodiment of the present invention is to provide an improved stackable and nestable beverage can tray having suitable end side openings for manual separation of nested trays and which will also enable automatic can tray packing apparatus to feed a nested stack of empty trays onto a conveyor.

Another object of this second preferred embodiment of the present invention is to provide an improved stackable and nestable beverage can tray having additional bottom members for primarily providing more tray bottom exterior surface area in contact with conveyors such as used in automatic can tray packing equipment.

The foregoing objects of the invention, and other objects which will become apparent hereinafter, are achieved through the provision in a first inventive embodiment of a molded, stackable and nestable beverage can tray having tapered side walls and end walls, contoured cutout windows in both the side walls and end walls to snugly contain the cans such that the bottom length and width dimensions of the tray are less than the sum of the diameters of rows of cans placed in the tray, a 3:2 length-to-width ratio for cross-tying stacks, a tray bottom design provided with a plurality of molded interlock standoffs projecting from the bottom of the tray to lock onto the top outer surfaces of the cans contained in subjacent trays, and molded tabs which prevent nested, empty trays from nesting too deeply and becoming locked together by material tension. In an improved second embodiment of the invention, the excessive nesting of stacked empty trays is prevented by a continuous top lip extending outwardly and upwardly from the tray walls and which includes upper end side openings for manually separating nested trays and for enabling automatic can tray packing equipment to feed a nested stack of empty trays onto a conveyor, wherein this second embodiment further includes downwardly extending arcuate rib members molded on the can tray bottom exterior surface to primarily provide extra tray bottom surface area in contact with a conveyor while avoiding the possibility of rupturing the top lid seals of subjacent tray cans. In both embodiments of the invention, the trays have side walls and end walls which are tapered at an angle of 10°, thereby enabling the trays to be nested to at least 67% of their overall height when stacked in an empty condition; the overall length and width dimensions of the bottom portions of the trays are also substantially reduced in comparison to those in the prior art by providing contoured can bottom receiving windows in the side walls and end walls.

DETAILED DESCRIPTION OF THE PREFERRED EMBODIMENTS

Figure 1:
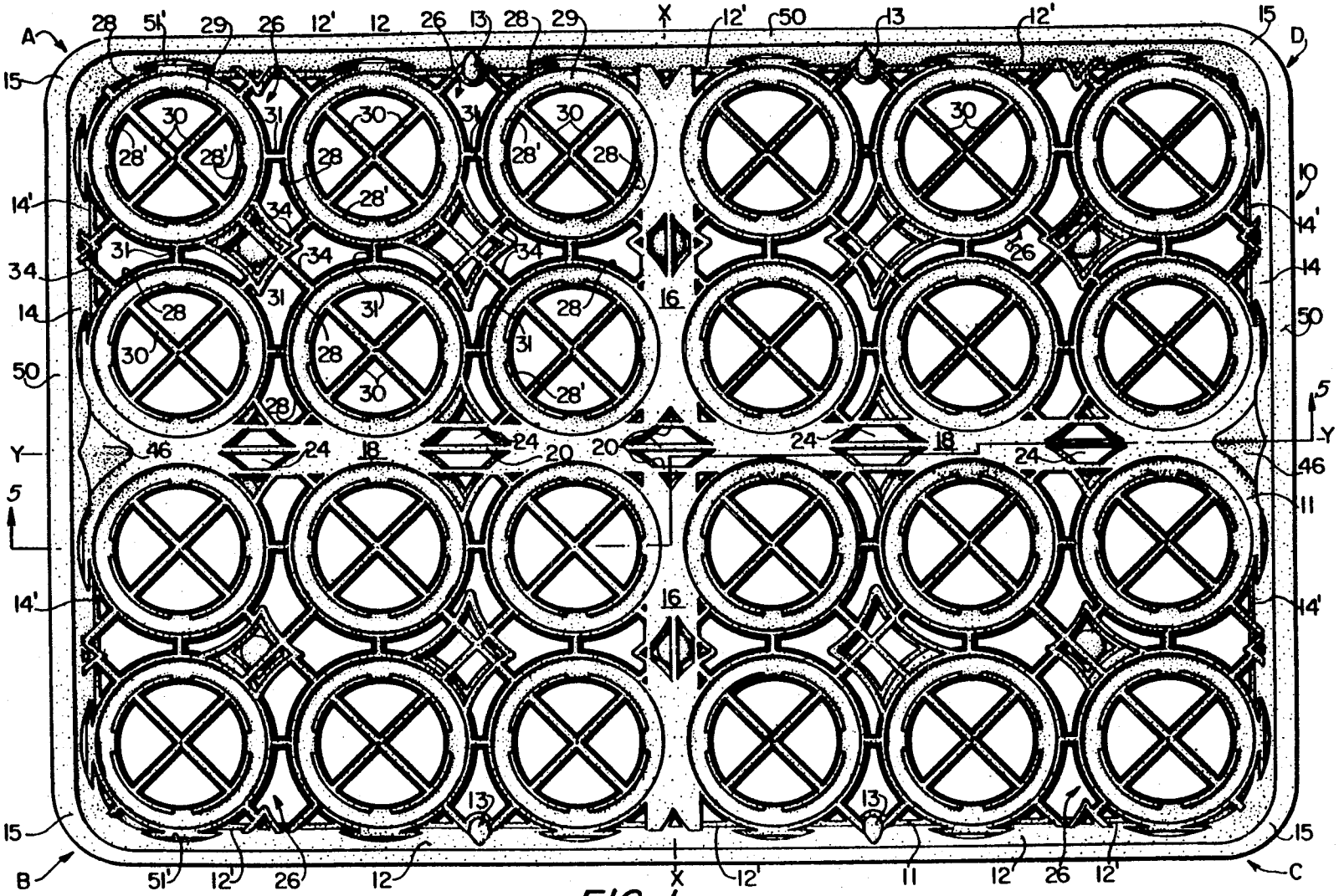
FIG. 1 is a top plan view of a first preferred embodiment of a beverage can tray according to the present invention.

In describing the preferred embodiments of the subject invention illustrated in the drawings, specific terminology is used for the sake of clarity. However, the invention is not intended to be limited to the specific terms so selected, and each specific term includes all technically equivalent terms for items operating in a similar manner to accomplish a similar purpose.

Referring generally to FIGS. 1 through 5, and referring specifically to FIG. 1, a top plan view of a first preferred embodiment of an injection molded unitary can tray according to the present invention is shown and is generally designated by reference numeral 10. The tray 10 is formed of molded identical end walls 14 and molded identical front and rear walls 12, which front and rear walls 12 and end walls 14 meet at four quarter-round-molded corners 15. The tray also includes a rectangular tray bottom portion 11 having front and rear edges 12' defined by the intersection of the bottom portion 11 with the lower edges of front and rear walls 12; similarly, the tray bottom portion 11 has end edges 14' defined by its intersection with the lower edges of end walls 14 as illustrated in FIG. 1.

Figure 2:
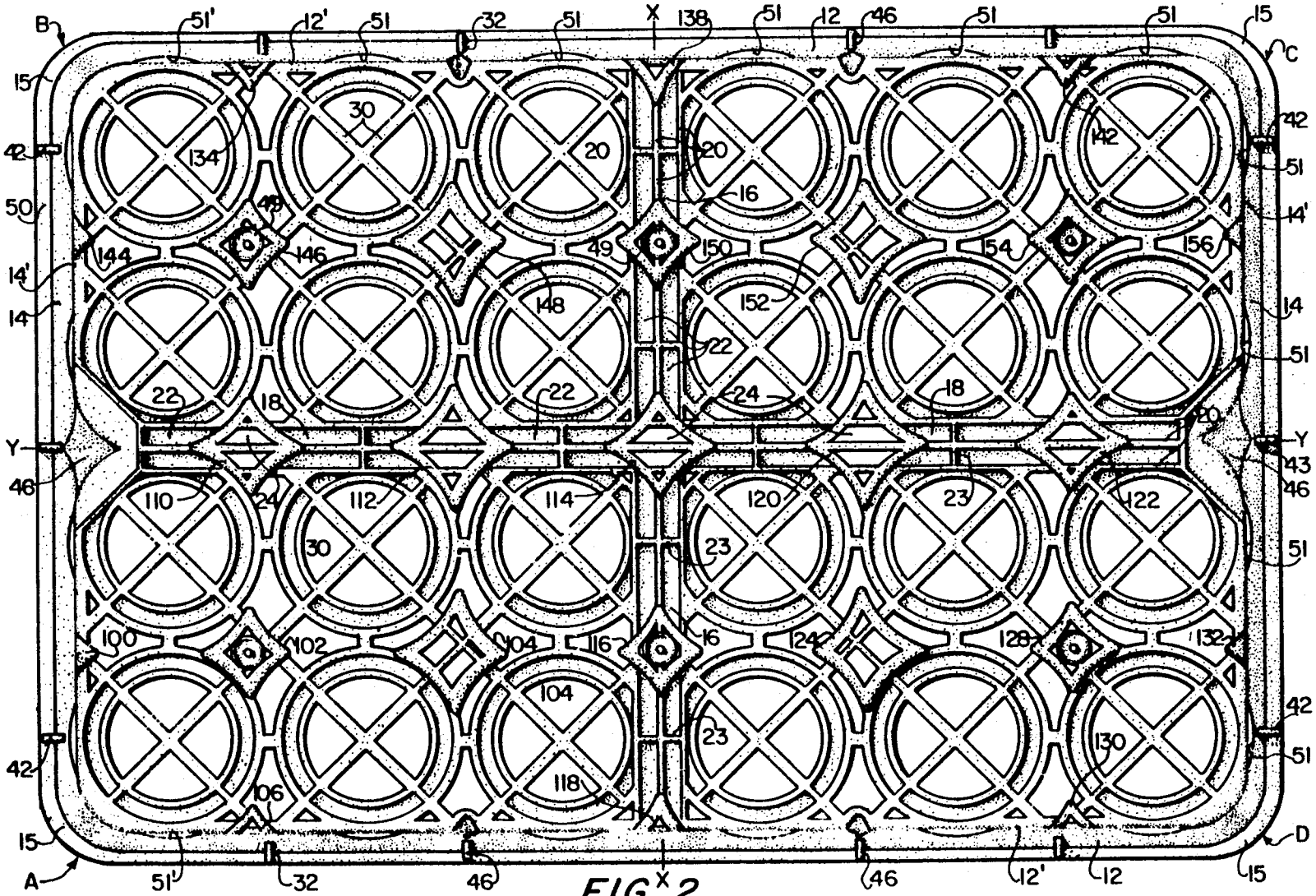
FIG. 2 is a bottom plan view of the tray of FIG. 1.

Structural strength is provided by elements of the bottom portion 11 of the tray 10 by means including two triple-rib center channels 16 and 18 formed unitarily in, and being part of, bottom portion 11. As FIGS. 1 and 2 show, channel 16 extends along a front to rear axis and connects perpendicularly to the walls 12 at a point approximately midway between the molded corners 15 such that a center line drawn along channel 16 defines a front to rear axis X. Similarly, channel 18 connects perpendicularly to the centers of end walls 14 at a point approximately midway between the corners 15 such that a center line drawn along channel 18 forms transverse axis Y. FIG. 2, the bottom plan view, shows in detail that channels 16 and 18 substantially comprise three parallel vertical ribs 20 joined by molded webbing 22, connected by transverse rib plates 23 and having cut-outs 24 in the webbing 22. Cut-outs 24 are generally trapezoidally-shaped, with the nonparallel sides being curved inwardly. This arrangement provides structural strength substantially equivalent to that provided b solid ribs having no channels or cut-outs, while allowing the angular surfaces of the trapezoids to be cored out from the top side of the tray.

The tray 10 depicted in FIG. 1 is divided by axes X and Y into four similar quadrants designated A, B, C and D. The structural arrangement of parts within each quadrant A, B, C or D is identical except for differences in location. For example, quadrant D is a geometric reflection (mirror image) of quadrant A over axis X. Similarly, quadrant C is a mirror image reflection of quadrant D over axis Y. Further, quadrant B is a mirror image reflection of quadrant A over axis Y. To preserve the clarity of FIGS. 1 and 2, reference numerals are mainly shown only for parts within quadrant A. However, it is intended and the reader should understand that the reference numerals apply to symmetrically identical parts shown in symmetrical quadrants B, C and D.

Figure 13:
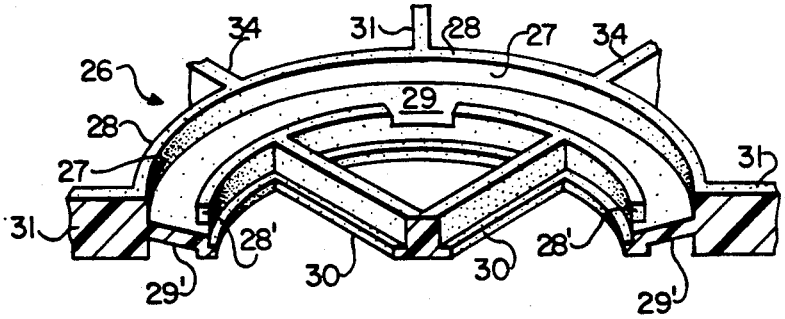
FIG. 13 is a partial perspective bisecting sectional view of one of the twenty four can support rings employed in the first preferred embodiment of the present invention.
Figure 14:
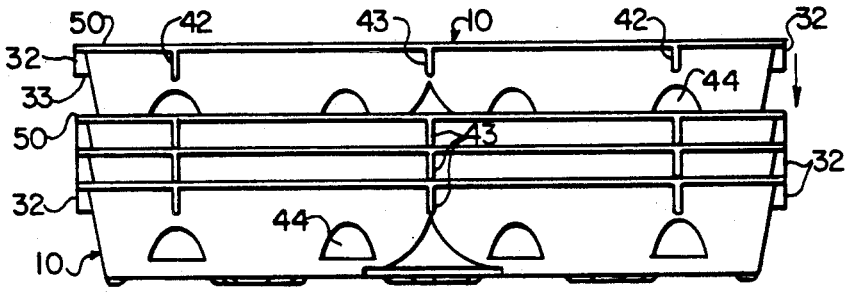
FIG. 14 is an end elevation view of a nested stack of empty trays according to the first preferred embodiment of the present invention.
Figure 17:
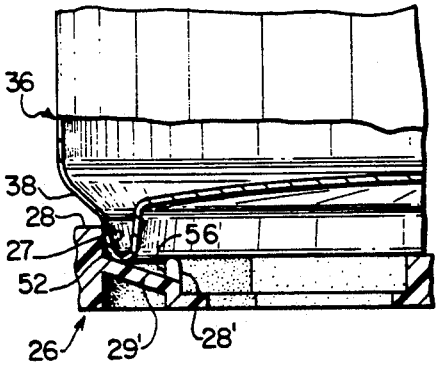
FIG. 17 is a partial sectional view of the lower end of a larger diameter can body illustrating its positioning in a can support ring of the type shown in FIG. 13.
Figure 18:
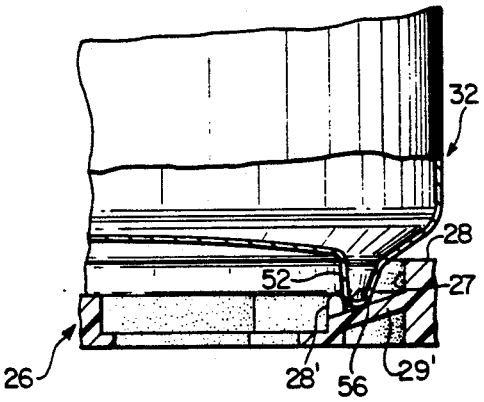
FIG. 18 is a partial sectional view of a smaller diameter can body similar to FIG. 17, but illustrating the manner of engagement of a smaller diameter can bottom with the can support ring.

It should be noted that quadrant A appears in a different position in FIG. 2 compared to FIG. 1. However, FIG. 2 is a bottom plan view obtained by conceptually rotating FIG. 1 180° about transverse axis Y. By conducting such a rotation of the top plan view, it may be seen that FIG. 2 properly shows the position of all quadrants. Each quadrant includes a plurality of molded can supports each generally designated 26 and including rings 28 formed unitarily in, and being part of, bottom portion 11 as shown in FIGS. 13, 17 and 18; can support rings 28 limit lateral motion of cans placed in the tray. In the preferred embodiment shown in FIG. 1, six can supports 26 are provided in each quadrant of the tray. The ring 28 of each can support 26 defines the outer extent of an annular channel 29, defined by the inner surface 27 of ring 28, interior ring segments 28' and a relatively flat conical annular floor 29' which slopes inwardly downward as shown in FIGS. 5, 13, 17 and 18.

As further shown in FIGS. 13, 17 and 18, interior ring segments 28' are molded having a height less than exterior rings 28. This structure permits the can tray rings to support and restrain cans having a range of bottom diameters including the larger diameter annular can bottom such as exemplified by can 36 in FIG. 17, or cans having smaller diameter annular can bottoms as exemplified by can 32 in FIG. 18. As specifically shown in FIG. 17, a can 36 having a standard annular bottom is seated in channel 29 with the can being retained in place by contact between the outer wall 38 of the can 36 and the inner surface 27 of ring 28.

In contrast, as shown in FIG. 18, cans 32 having a smaller diameter annular can bottom are also seated in channel 29, but are laterally retained in place by contact between the inner surface 56 of the can bottom annular rib and the outer surface of interior ring segment 28'. The double ring structure, including rings 28 and ring segments 28' according to the present invention, represents a significant advance over the prior art in that it permits cans having a range of can bottom diameters to be used in the same can tray. The rings and annular rib will also cause a can of intermediate size to center itself while rings 28' prevent excessive movement. A further significant aspect of the invention is that the conical annular floor 29' will tend to center a range of can diameters in the can support 26 in an obvious manner.

Four ring segments 28' are used, rather than a contiguous inner ring, to permit drainage of any moisture or spilled fluid which may collect in channel 29. Such fluid will drain through the spaces between segments 28' and out the tray 10, thereby preventing accumulation of fluid in channel 29.

Each ring 28, ring segment 28' and channel 29 is braced by diagonal cross ribs 30 shown in FIGS. 1, 2 and 13. The ribs 30 help distribute can weight to the entire tray 10, and the ribs 30 further ensure that the tray 10 remains rigid against torque or force exerted to twist or bend the tray 10 along a plane perpendicular to the ribs 30. Cross ribs 30 are used rather than a solid bottom for the rings 28 to save molding material and reduce tray weight. The ribs 30 are also valuable in providing structural strength against stress applied in a diagonal direction with respect to walls 12 or 14 of tray 10. The can supports 26 are interconnected by ring link ribs 31 (FIGS. 1, 2 and 13) and diagonal extension ribs 34, which ribs transmit stress to adjacent rings 28 of different can supports where such stress is absorbed.

In an alternative configuration, depicted in FIGS. 6 through 9, the rings 28, ring segments 28', conical annular floor members 29' and ribs 30 are molded to incorporate year date coding rings 900 and month date coding rings 950. As shown in the top plan view of FIGS. 7 and 9, the date coding ring 900 and the month coding ring 950 have a generally disk shaped, flat molded top. Specifically year date coding ring 900 includes top molded surface 902, and month coding ring 950 includes top molded surface 952. In the bottom plan view of FIG. 6, the details of year date coding ring 900 are shown. The ring 900 is defined by outer circular rib 912 and interior flat surface 904. Upon surface 904 is molded a year date ring 906, into which a plurality of numerical year codes 914 are molded. A molded arrow 908 is provided, molded upon interior planar surface 910. Depending upon the year of manufacture of a tray 10, the arrow 908 is molded to point to the appropriate year date molded into ring 906.

Figure 8:
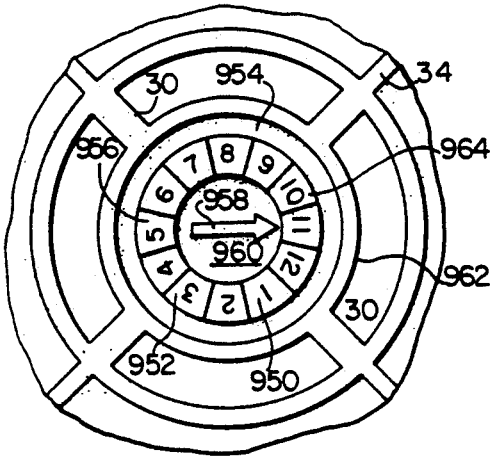
FIG. 8 is a bottom plan view of a molded month date coding ring that can be incorporated in all embodiments of the present invention.

The similar details of month coding ring 950 are shown in FIG. 8. The perimeter of ring 950 is defined by ring rib 962, and is filled with a flat planar molded surface 954. A raised molded month coding ring 956 is provided, and numerals 964, corresponding to months of the calendar year, are molded into the ring 956. The interior of ring 956 is filled by flat circular planar surface 960. A raised molded indicator arrow 958 is provided, and depending upon the month of manufacture of a tray 10, the arrow 958 is molded to point to a corresponding numeral 964.

FIGS. 1, 3, 4, 5 and 14 show in detail the structural details which permit the empty trays to be nested in a space-saving manner while permitting an easy separation of the nested trays. More specifically, front and rear walls 12 and end walls 14 of the tray 10 are integrally connected at their upper edges to a peripheral top lip 50 extending the full length and width of the tray 10. A plurality of front and rear tabs 32 (FIG. 4), preferably four tabs 32, protrude outwardly (forwardly or rearwardly) from walls 12 and downwardly from top lip 50 with tabs 32 being connected perpendicularly to and of the walls 12 and lip 50. End tabs 42 identical to tabs 32 are provided on end walls 14 and are identically connected to the lower surface of top lip 50 in the same manner as tabs 32. The tabs 32 are shown in profile in FIG. 4. The tabs 32 and 42 add structural strength to the tray; further, the tabs 32 and 42, respectively, have lower edges 33 and 43 which rest on the upper surface of a subjacent top lip when in empty stacked array as in FIG. 14 to prevent empty nested trays 10 from nesting too deeply. When a plurality of empty trays 10 are nested, the bottom surfaces 33 and 43 of the tabs 32 and 42 engage the lip 50 of the subjacent tray. Thus, the tabs 32 and 42 prevent one tray 10 from being forced too deeply into a tray 10 below it, which deep nesting causes prior art trays to become wedged within each other such that they can be extremely difficult to separate.

The tabs also prevent the top lip 50 from riding over or under the top lip of an adjacent tray if tray side walls collide when a palletizer machine squares up each tier of a pallet load or when the trays are travelling on conveyors.

Figure 3:
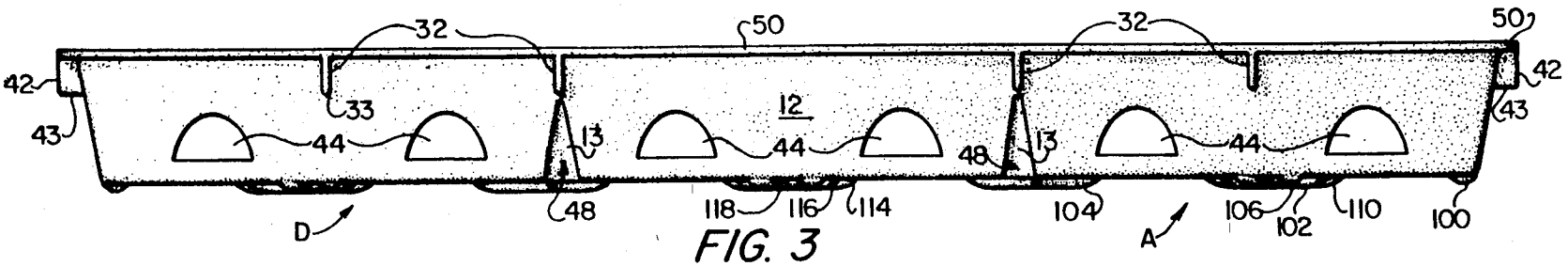
FIG. 3 is a side elevation view of the tray of FIG. 1.

Front and rear walls 12 are further provided with preferably two molded external notches 48 formed of inwardly bulging wall portions 13 (FIGS. 1 and 3) each of which is aligned with one of the notch tabs 32 as shown in FIG. 3. The tabs 32, in conjunction with notches 48, increase the structural strength of walls 12 by cooperatively forming a barrier highly resistant to stress applied perpendicular to end walls 14. Thus, the notches 48 and tabs 32 strengthen the walls 12 against lateral force exerted when tray ends are pushed against each other in a palletized stack.

End walls 14 each include a centrally molded externally positioned notch 45 formed of inwardly bulging wall positions 46 (FIG. 1) in vertical alignment with an end tab 42. The aforementioned end tab, in conjunction with notch 45, increases the structural strength of end walls 14 which resists stress applied perpendicular to front and rear walls 12. Thus, the end walls 14 are strengthened against sudden lateral force exerted when front and rear walls 12 of adjacent trays are pushed against each other in a palletized stack.

Figure 4:
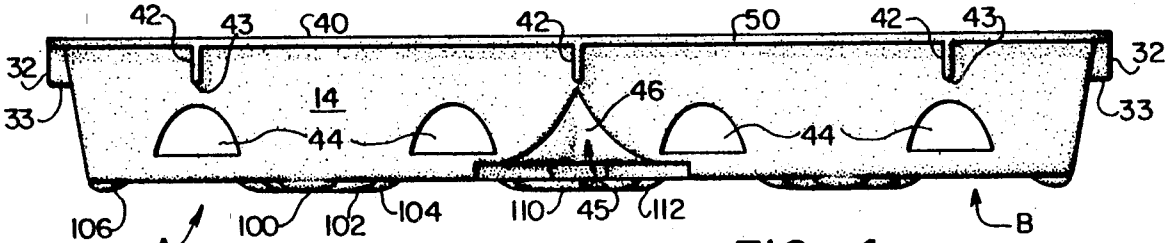
FIG. 4 is an end elevation view of the tray of FIG. 1.
Figure 5:
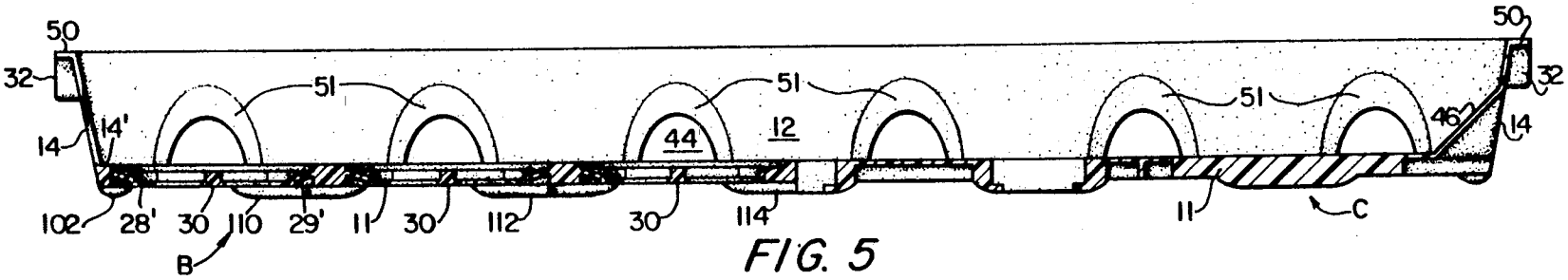
FIG. 5 is a section view taken at line 5—5 of FIG. 1.
Figure 7:
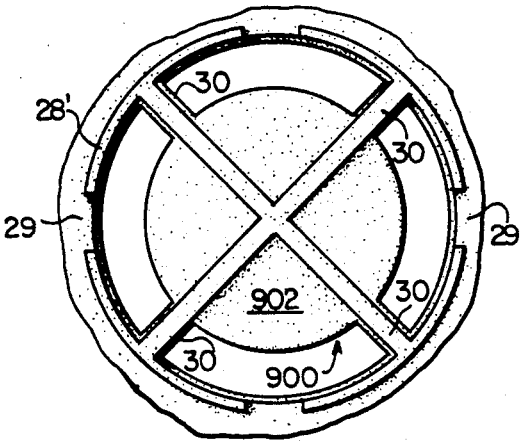
FIG. 7 is a top plan view of the year date coding ring shown in FIG. 6.
Figure 6:
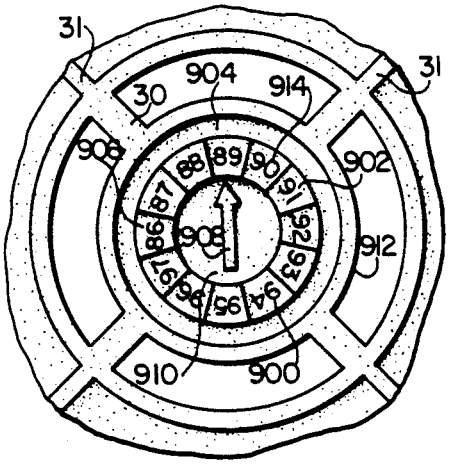
FIG. 6 is a bottom plan view of a molded year date coding ring that can be incorporated in all embodiments of the present invention.
Figure 9:
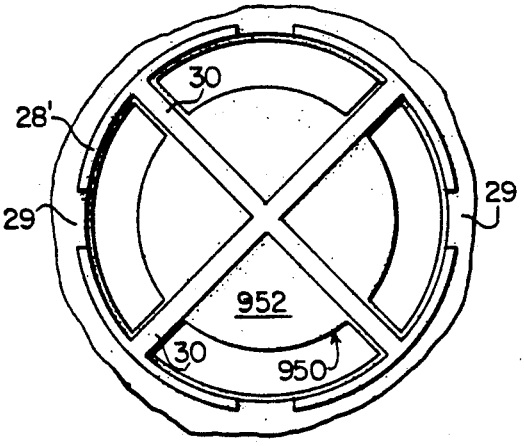
FIG. 9 is a top plan view of the date coding ring of FIG. 8.

As is further shown by FIGS. 3, 4 and 5, end walls 14 and front and rear walls 12 are provided with a plurality of contoured cut-out windows 44 each of which provides clearance space for receiving a portion of the lower end of a can placed within the tray 10. In the preferred embodiment illustrated in the drawings, front and rear walls 12 are provided with six windows 44 and end walls 14 are provided with four windows 44.

The contoured windows are generally elliptically arcuate in shape, a shape produced by conceptually intersecting the walls 12 and 14 with a vertical cylinder identical to a right cylindrical can body seated in a channel 29 of the tray 10 to define an elliptical arcuate cylindrical surface bordering each opening 44 on the inner surface of its respective wall. Although walls 12 and 14 are angled, the sides of a right cylindrical can body placed within the tray 10 are perpendicular to the tray bottom plane; consequently, the elliptically arcuate cylindrical contour surfaces 51 of windows 44 shown in FIGS. 1, 2 and 5 are not angled but rather are perpendicular to the tray bottom plane. Surfaces 51 conform to the cylindrical surface of the lower end of a can positioned adjacent each surface 51.

Use of the windows 44 permits the peripheral dimensions of the tray bottom portion to be less than the overall length and width of rows of cans placed in the tray. In other words, the distance between front and rear edges 12' of the tray bottom portion 11 is less than the distance between the front and rear facing cylindrical surfaces 51 (such as exemplified by the facing cylindrical surfaces labelled 51' in FIG. 1). Similarly, the distance between end edges 14' of the can bottom portion 11 is less than the distance in the y axis direction between the facing cylindrical surfaces labelled 51'' in end walls 14 in FIG. 1. Thus, a row of six cans extending in the Y axis direction between surfaces 51'' would have a total length (equal to six times the diameter of each can) greater than the distance between end edges 14'; similarly, a front-to rear row of four cans extending in the X axis direction between surfaces 51' would have a greater length (equal to four times the diameter of each can) than the distance between front and rear edges 12' of the bottom portion of the tray.

The employment of a tray bottom having such length and width dimensions less than the length and width dimensions of can rows used in the tray is essential to permit interlocked cross-tied stacking of trays with a minimum overhang of the perimeter of a pallet. If the peripheral dimensions of the tray were larger, a desired cross-tied stacked arrangement of trays would overhang the perimeter of a standard pallet to a greater degree, exposing the cans and trays to damage by the fork lift trucks used to warehouse and ship them.

Figure 10A:
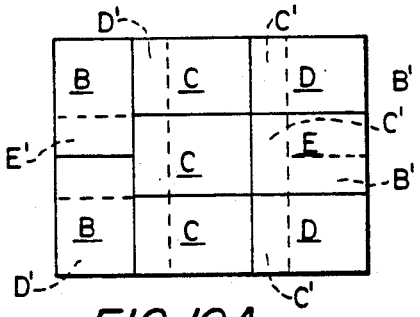
FIG. 10A is a schematic top plan view of two eight can tray tiers showing some of the different positions which can trays according to all embodiments of the present invention may occupy within a pallet tier relative to subjacent can trays.

Further, with larger tray dimensions it would be impossible to use a cross-tied stacked, palletized arrangement while maintaining relatively close axial alignment of cans in subjacent and superior can rows. Axial misalignment of cans in subjacent and superior can rows of stacked trays occurs because subjacent and superior can trays may be rotated 90° with respect to one another with such rotation causing a shifting of trays in proportion to the number of trays arranged in a particular tier array. FIG. 10A schematically depicts the arrangement of two eight can tiers of can trays in a cross-tied palletized arrangement. Many other cross-tied palletized arrangements may be practiced, to facilitate use of the invention with different pallet sizes. Examples of other cross-tied palletized arrangements commonly practiced in the beverage can industry are illustrated schematically in FIGS. 11A, 11B and 11C.

Figure 10B:
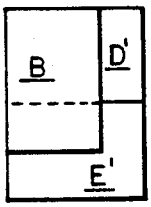
FIG. 10B is a schematic plan view illustrating a first position which a can tray according to all embodiments of the present invention may occupy relative to subjacent can trays within the pallet arrangement of FIG. 10A.
Figure 10C:
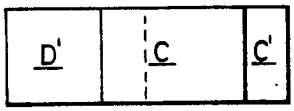
FIG. 10C is a schematic plan view illustrating a second position which a can tray according to all embodiments of the present invention may occupy relative to subjacent can trays within the pallet arrangement of FIG. 10A.
Figure 10D:
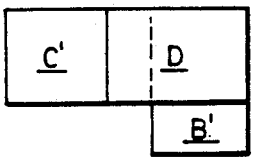
FIG. 10D is a schematic plan view illustrating a third position which a can tray according to all embodiments of the present invention may occupy relative to subjacent can trays within the pallet arrangement of FIG. 10A.
Figure 10E:
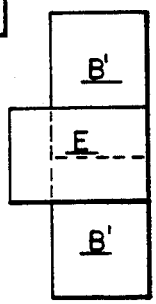
FIG. 10E is a schematic plan view illustrating a fourth position which a can tray according to all embodiments of the present invention may occupy relative to subjacent can trays within the pallet arrangement of FIG. 10A.
Figure 11A:
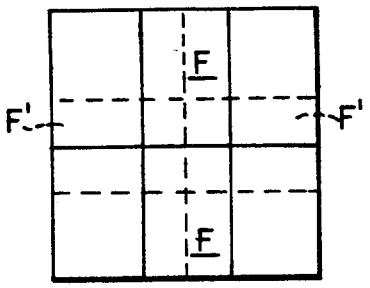
FIG. 11A is a schematic top plan view of a six can tray per pallet tier arrangement.

The solid lines in FIG. 11A depict six trays per tier. In the pattern shown in FIG. 11B each tier comprises seven trays. Further, the palletizing patterns shown in FIGS. 10A and 11C each comprise eight trays per tier. These four palletizing patterns may be constructed by placing can trays in one of six different positions B, C, D, E, F and G, as shown in FIGS. 10B through 10G. The subject inventive tray is provided with downwardly protruding interlock standoffs for engaging the upper ends of subjacent cans to accommodate for each different position which the cans may occupy in the respective different stacked arrangements.

In the arrangement shown in FIG. 10A, superior can trays (those in the upper tier) are outlined in solid lines and subjacent can trays (those in the lower tier) are outlined using phantom lines. As indicated on FIG. 10A a given superior can tray may occupy any one of four positions with respect to subjacent can trays with the trays in such four possible positions being labelled B, C, D or E.

It will be observed that the cans in the subjacent tier are arranged relative to each other in a manner identical to the relative arrangement of the cans in the upper tier; however, the lower tier is rotated 180° relative to the upper tier. The trays in the subjacent tier are labelled with printed designators B', C', D' and E' which respectively correspond to positions B, C, D and E of the upper tray. As is shown in detail in FIG. 10A, both of the can trays labelled B rest on portions of two subjacent can trays D' and E' having their transverse axes Y parallel in the manner illustrated by the rearmost tray B (as viewed in FIG. 10A) as shown in FIG. 10B. However, any one of the three can trays C of FIG. 10A rests directly above two end-to-end abutted can trays (e.g., C' and D') of the subjacent tier in the manner shown in detail in FIG. 10C. Further, as shown in FIG. 10D, the rearmost can tray D of FIG. 10A rests directly above and on two subjacent can trays B' and C' which are arranged perpendicular to one another. The forwardmost can tray D of FIG. 10A rests on the forwardmost tray B' and the forwardmost tray C' of the subjacent tray. A can tray E of the upper tier in FIG. 10A rests horizontally atop two end-to-end abutted can trays B' and the middle can tray C' of the subjacent row, as shown in detail in FIG. 10E.

Figure 10F:
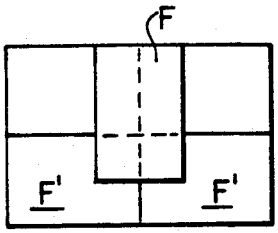
FIG. 10F is a schematic plan view illustrating a fifth position which a can tray according to all embodiments of the present invention may occupy relative to subjacent can trays within the pallet arrangement of FIG. 11A.

Can tray F of the six can tray array of FIG. 11A rests on four subjacent trays B', B', F' and F' which are rotated 90° from the trays of the upper tier as shown in FIG. 10F. The four remaining trays of FIG. 11A are corner trays B supported by subjacent trays in exactly the same manner as can trays B of FIG. 10A.

Figure 11B:
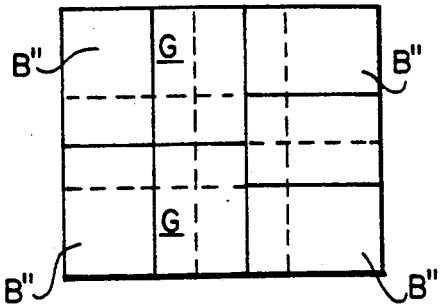
FIG. 11B is a schematic top plan view of a seven can tray per pallet tier arrangement.
Figure 10G:
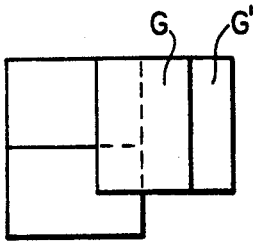
FIG. 10G is a schematic plan view illustrating a sixth position which a can tray according to all embodiments of the present invention may occupy relative to subjacent can trays within the pallet arrangement of FIG. 11B.

The two can tray positions G of the seven can tray uppermost tier of FIG. 11B are illustrated in FIG. 10G. It should be observed that the four can trays B" defining the corners of the upper tier of FIG. 11B are supported by two subjacent trays in the exact same manner as trays B of the upper tier of FIG. 10A. Tray F" is supported by four subjacent trays in the exact manner as tray F of FIGS. 11A and 10F. The lower tier of trays in FIG. 11B is rotated 180° from the upper tier of which it is consequently a mirror image.

Figure 11C:
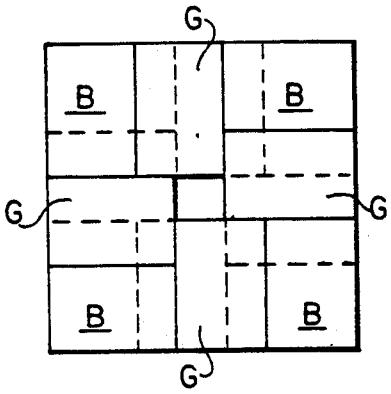
FIG. 11C is a schematic top plan view of a second eight can tray per pallet tier arrangement.

FIG. 11C illustrates an eight can tray tier arrangement in which the can trays in the lower tier are rearranged to support the upper tier can trays as shown. The can trays B of the upper tier of FIG. 11C are supported by two subjacent can trays in the exact same manner as can trays B of FIG. 10A; similarly the can trays G of FIG. 11C are supported by three trays in the manner of the rearmost G of FIG. 11C as illustrated in FIG. 10G.

The design of the interlocked standoffs of a tray 10 according to the present invention accommodates placement of the tray 10 relative to subjacent trays in any of the positions exemplified by trays B, C, D, E, F or G. Specifically, the tray according to the invention is capable of interlocking with cans in subjacent trays in at least six different positions in which the tray is place in a superior tier. Additionally, the interlock standoffs account for the fact that the pallet arrangement shown in FIGS. 10A and 11B could be rotated 180°, thereby creating a mirror image of the center-line locations of the cans in each of the four positions. The design of the standoffs is discussed below in detail. Depending upon the arrangement of adjacent loaded trays, the distance between axes of widely spaced-apart cans may change substantially. For example, as shown schematically in FIG. 12, if three loaded trays 300, 400 and 500 are placed adjacent to one another such that their walls 12 are flush, twelve cans in a front to rear extending row 600 parallel to end walls 14 of the three trays 300, 400 and 500 will be interrupted by two double tray wall thicknesses 603 and 602, each of which is equal to the distance between facing cans of two trays such as, for example, cans 604 and 606 in FIG. 12. In contrast, if two trays 700 and 800 are placed end-to-end such that their end walls 14 are adjacent, only one double tray wall thickness 802 will be interposed in a row 610 of twelve cans. Thus, the distance between the first can 611 of row 610 and the sixth can 620 of that row is less than the distance between corresponding first and sixth cans 601 and 622 of row 600, with the difference being equal to the spacing between cans 604 and 606 of row 600 caused by double wall thickness 603. In like manner, the distance between first can 601 and twelfth can 624 of row 600 is greater than the distance between the first and twelfth cans 611 and 626 of row 610.

Figure 12:
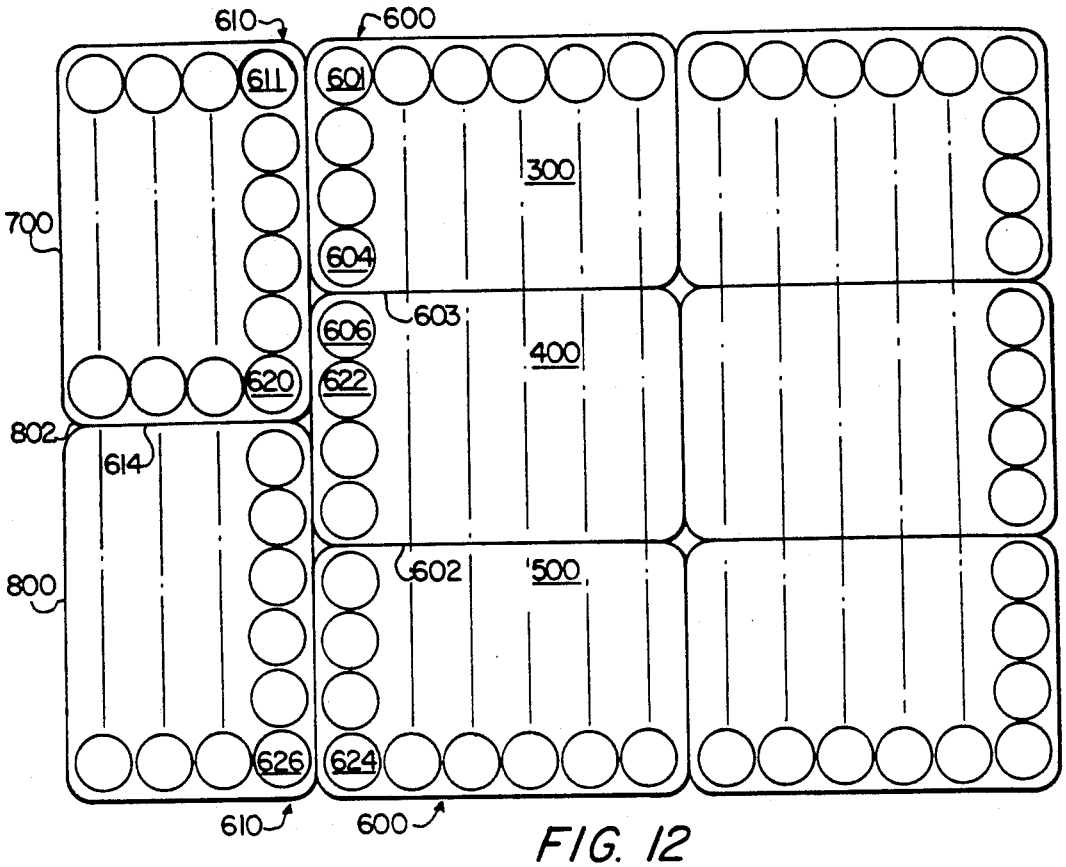
FIG. 12 is a schematic top plan view of one tier of a palletized stack of eight beverage can trays arranged in the manner of FIG. 10A with the can diameter profiles being illustrated therein.

The different number of walls potentially interposed in a row of a given number of cans can cause the distance between cans to vary greatly both in the X and Y direction. This varying distance causes the axes of cans in subjacent and superior rows to become misaligned in cross-tied pallet stacks. For example, as shown in FIG. 12, cans 620 and 622 are misaligned. As a result of this misalignment, as discussed further below, the can trays 10 are provided with downwardly protruding interlock standoffs for engagement with cans of a subjacent tier which permit interlocking with cans despite the varying misalignment position of cans in vertically adjacent stacked trays.

Figure 16:
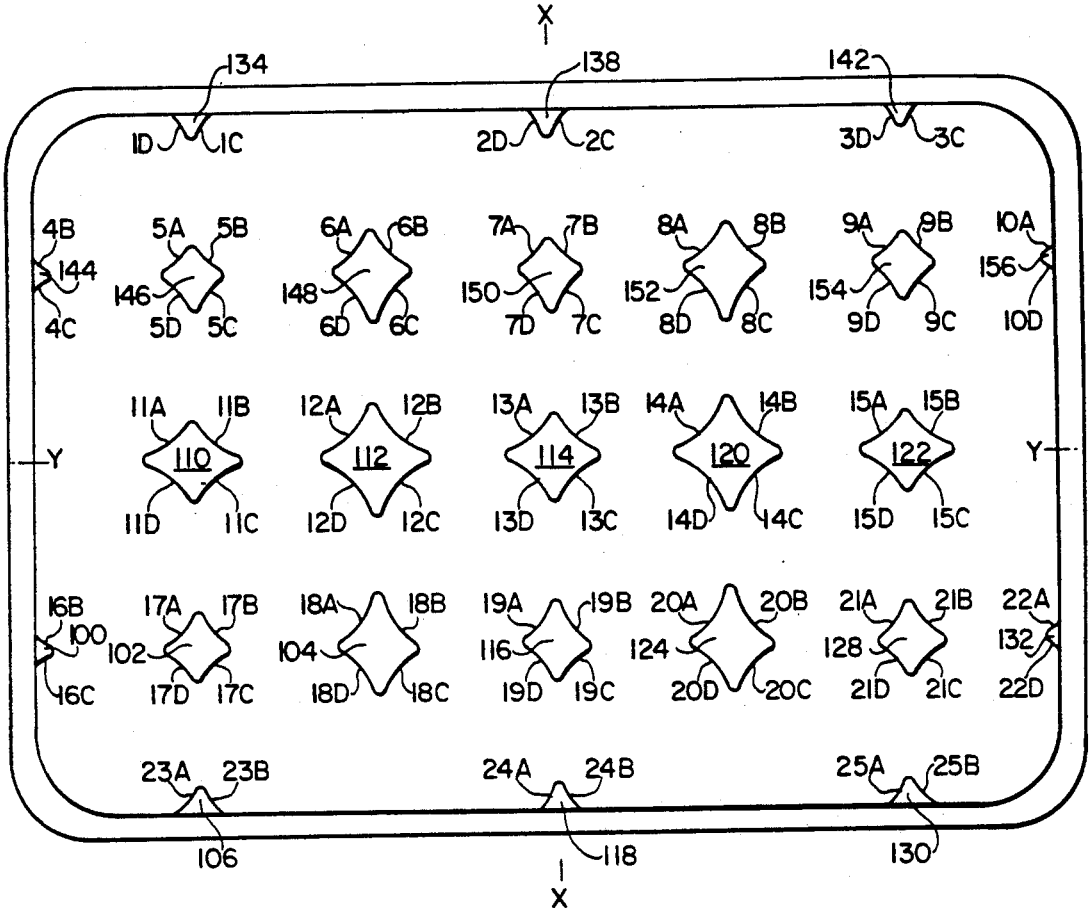
FIG. 16 is a schematic bottom plan view of a portion of a tray according to all embodiments of the present invention showing the arcuate can engaging surfaces of interlock standoffs provide to engage the sides of the upper ends of subjacent cans

More specifically, referring now to FIGS. 2, 3, 4 and 5, the bottom of the tray is provided with downwardly protruding interlock standoffs including six front/rear wall adjacent identical standoffs 106, 118, 130, 134, 138 and 142 as best shown in FIGS. 2 and 16 and four identical end wall adjacent standoffs 100, 144, 156 and 132. Additionally, Y axis standoffs 110, 112, 114, 120 and 122 are positioned along the Y axis, and X axis standoffs 116 and 150 are positioned along the X axis along with front/rear standoffs 118 and 138 and standoff 114 which is positioned over the intersection of the X and Y axes. All standoffs serve to engage portions of the top edges of cans placed in a subjacent loaded tray. The standoffs, thus, operate to prevent lateral movement of loaded can trays in a palletized stack by providing a positive stop against which can top outer walls may rest during sudden lateral movement.

It should be noted that standoffs 102, 104, 116, 124 and 128 are mirror images of standoffs 146, 148, 150, 152 and 154, respectively; similarly, standoffs 110 and 112 are mirror images of standoffs 122 and 120, respectively. Different shapes are required because when a plurality of trays 10 are stacked atop a pallet in a cross-tied stack, such that subjacent trays are oriented at a 90° angle with respect to superior trays, can tops of subjacent trays are not always axially aligned with can bodies placed in superior trays.

Due to axial misalignment discussed in detail above, the outer top wall of a can placed within a subjacent tray is not always aligned directly below a can support ring 28 of a superior tray. Therefore, the arcuate edges of standoffs 102 through 156 are designed to accommodate for the possible distance to which a particular can edge in a subjacent row may extend.

Figure 15:
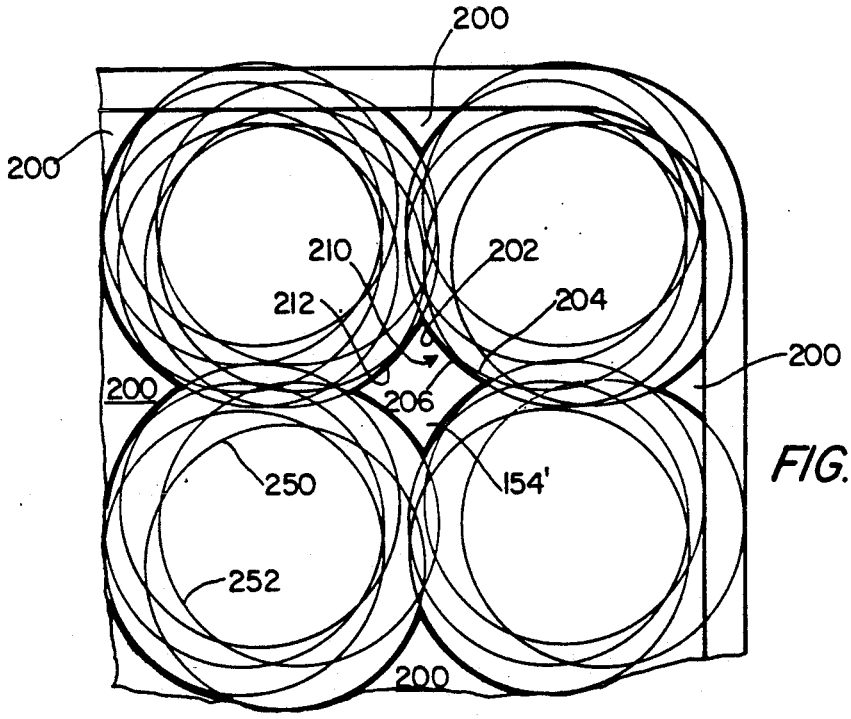
FIG. 15 is an exaggerated non-scale schematic plan view of possible can positions within a tray according to all embodiments of the present invention.

The exact shape of the standoffs is determined by plotting a schematic diagram of all possible can locations for all possible positions and rotations of subjacent and superior trays in a given stacked, interlocked, cross-tied pallet arrangement. FIG. 15 is a diagram plan view of all possible can positions for four cans of one quadrant. Such a schematic diagram is simply one way of visualizing the different distances which may separate cans due to the varying number of wall thicknesses which may be interposed in can rows in the various cross-tied pallet arrangements. After the circular profiles of all such can locations are plotted as represented by circles such as 250 and 252 of FIG. 15, the open spaces between the can profiles, such as space 154' in FIG. 15, indicate essentially the final shape of the standoffs for that particular position, which in the case of FIG. 15, would be standoff 154; however, the standoffs are provided with rounded corners rather than sharp edges as will be apparent from comparison of standoff 154 with open space 154'.

However, in some cases in which two or more can positions are extremely close, a complex curve 210 is created comprising multiple arcuate portions 202 whose ends 204 are joined at a relatively acute angle 206. In these cases, as shown in FIG. 15, the design of the standoff is slightly changed to remove the acute angle 206 and to smooth the complex multiple arcuate curve 210 into a single smooth curve such as curve 212. Such curve smoothing simplifies the task of preparing a master can tray mold, and reduces the amount of molding material required to produce a tray, without substantially reducing the amount of contact made between cans and interlock standoffs having smoothed curves.

Since the standoffs provide clearance for the most greatly misaligned can associated with a given tray can axis position, all of standoffs 100 through 156 do not necessarily contact a subjacent can in a given tray position. In one case, specifically arcuate surface 18D of interlock 104 (FIG. 16), the arcuate surface of an interlock will be directly flush against the side of the top of a can in a subjacent tray. However, as few as 16 of the 25 standoffs may actually contact and laterally restrain subjacent cans in a fully-loaded subjacent tray. Fortunately, contact by less than all of the standoffs is sufficient to ensure load stability given the large number of trays present in a typical stacked, cross-tied, palletized arrangement.

The standoffs of a given tray which contact cans in a given subjacent tray may be predicted for all possible tray locations within a pallet using information presented in schematic FIG. 16 and the standoff pad identification chart shown in Table 1. In FIG. 16, each arcuate surface of each protruding standoff of all trays according to the present invention is designated by a specific reference number and letter.

Table 1 has vertical columns B through G which correspond to the superior tray to subjacent tray relationships B through G within one of the four preferred palletized arrangements shown in FIGS. 10A, 11A, 11B and 11C. The horizontal rows of Table 1 correspond to the arcuate surfaces of protruding standoff pads identified in FIG. 16. Thus, by referring to Table 1, and choosing the column corresponding to the superior tray relationship to a subjacent tray of a can tray within a pallet stack, the protruding interlock standoff arcuate surfaces which will contact cans in a subjacent tray may be determined.

TABLE 1

The Interlock Pad Identification Chart
The Interlock Pad Identification Chart shown below identifies which of the Interlock Pads are in use in each of the six basic palletizing positions

| Interlock Pad Identification | Superior Tray Relationship To Subjacent Tray Number | | | | | |
|---|---|---|---|---|---|---|
| | B | C | D | E | F | G |
| 1C | x | x | x | x | x | x |
| 1D | | x | x | | | x |
| 2C | | x | x | x | | x |
| 2D | | x | x | x | | x |
| 3C | | x | x | | | x |
| 3D | x | x | x | x | x | x |
| 4B | x | | | x | x | x |
| 4C | | x | x | | | |
| 5A | x | | | | x | |
| 5B | x | | | x | x | x |

TABLE 1-continued

The Interlock Pad Identification Chart
The Interlock Pad Identification Chart shown below identifies which of the Interlock Pads are in use in each of the six basic palletizing positions

| Interlock Pad Identification | Superior Tray Relationship To Subjacent Tray Number | | | | | |
|---|---|---|---|---|---|---|
| | B | C | D | E | F | G |
| 5C | | x | x | x | x | x |
| 5D | | x | x | | | x |
| 6A | x | | | | x | |
| 6B | x | | | x | x | |
| 6C | | x | x | x | | x |
| 6D | | | x | | | x |
| 7A | x | | | x | x | |
| 7B | x | | | x | x | |
| 7C | | x | x | | | x |
| 7D | | x | x | x | | x |
| 8A | x | | | x | x | |
| 8B | x | | | | x | |
| 8C | | x | x | | | x |
| 8D | | x | x | x | | x |
| 9A | x | | | x | x | x |
| 9B | x | | | | x | |
| 9C | | x | x | | | |
| 9D | | x | x | | | x |
| 10A | x | | | x | x | x |
| 10D | | x | x | | | |
| 11A | x | | | | x | |
| 11B | x | | | x | x | x |
| 11C | x | | | x | x | x |
| 11D | x | | | | | |
| 12A | x | | | | x | |
| 12B | x | | | x | x | |
| 12C | x | | | x | x | |
| 12D | x | | | | | |
| 13A | x | | | x | x | |
| 13B | x | | | x | x | |
| 13C | x | | | x | x | |
| 13D | x | | | x | x | |
| 14A | x | | | x | x | |
| 14B | x | | | | x | |
| 14C | x | | | | x | |
| 14D | x | | | x | x | |
| 15A | x | | | x | x | x |
| 15B | x | | | | x | |
| 15C | x | | | | x | |
| 15D | x | | | x | x | x |
| 16B | | x | x | | | |
| 16C | x | | | x | x | x |
| 17A | | x | x | | | x |
| 17B | | x | x | | | x |
| 17C | x | | | x | x | x |
| 17D | x | | | | | |
| 18A | | x | x | | | x |
| 18B | | x | x | x | | x |
| 18C | x | | | x | x | |
| 18D | x | | | | x | |
| 19A | | x | x | | | x |
| 19B | | x | x | x | | x |
| 19C | x | | | x | | x |
| 19D | x | | | x | | x |
| 20A | | x | x | x | | x |
| 20B | | | x | | | x |
| 20C | x | | | | x | |
| 20D | | | | x | x | |
| 21A | | x | x | x | | x |
| 21B | | x | x | | | x |
| 21C | x | | | | x | |
| 21D | x | | | x | x | x |
| 22A | | x | x | | | |
| 22D | x | | | x | x | x |
| 23A | | x | x | | | x |
| 23B | x | x | x | x | x | x |
| 24A | | x | x | x | | x |
| 24B | | x | x | | | x |
| 25A | x | x | x | x | x | x |
| 25B | | x | x | | | x |

Referring now to FIG. 2, the preferred embodiment of a can tray according to the present invention includes six molding gates 49 to facilitate filling of the can tray mold using a conventional plastic injection-molding technique. Since can trays according to the present invention are relatively large, provision of plural plastic injection points on the mold is essential to ensure that the molded trays cool evenly and consistently. Using fewer injection molding gates 49 might cause different portions of a molded can tray 10 to cure at different rates, producing differential shrinkage and resulting warpage of the finished molded tray. This effect is eliminated by using a plurality, preferably six, of injection molding gates for filling the can tray mold with molten plastic.

FIGS. 19 through 30A show or relate to a second preferred and improved embodiment of an injection molded unitary can tray 200 which incorporates the following changed or additional features: (1) a continuous lip extending outwardly and upwardly at the top of the tray wall around its perimeter for permitting deep but not excessive nesting and sticking of the trays; (2) openings in the upwardly extending end sides of this perimeter lip for manually separating nested empty trays and to enable conventional automatic can tray packing equipment to feed a nested stack of empty trays onto a conveyor, and (3) downwardly extending arcuate ribs molded on the can tray bottom exterior surface to primarily provide more tray bottom exterior surface area in contact with a conveyor. To avoid repeating the description of elements that are common to both of the first and second embodiments, reference numbers are used for many of these common elements in FIGS. 19 through 30A which are the same as the reference numbers used for identical elements in FIGS. 1 through 18 that have already been described in connection with the first tray 10 embodiment. Therefore, reference should be made to the preceding specification text for a detailed description of the nature and function of these common elements, including those common elements in FIGS. 19-30A whose reference numbers are omitted because of space considerations. Elements that have been added to or represent a change in the construction of the improved second tray embodiment in FIGS. 19 through 30A are identified by a series of new reference numbers beginning with 200.

Figure 19:
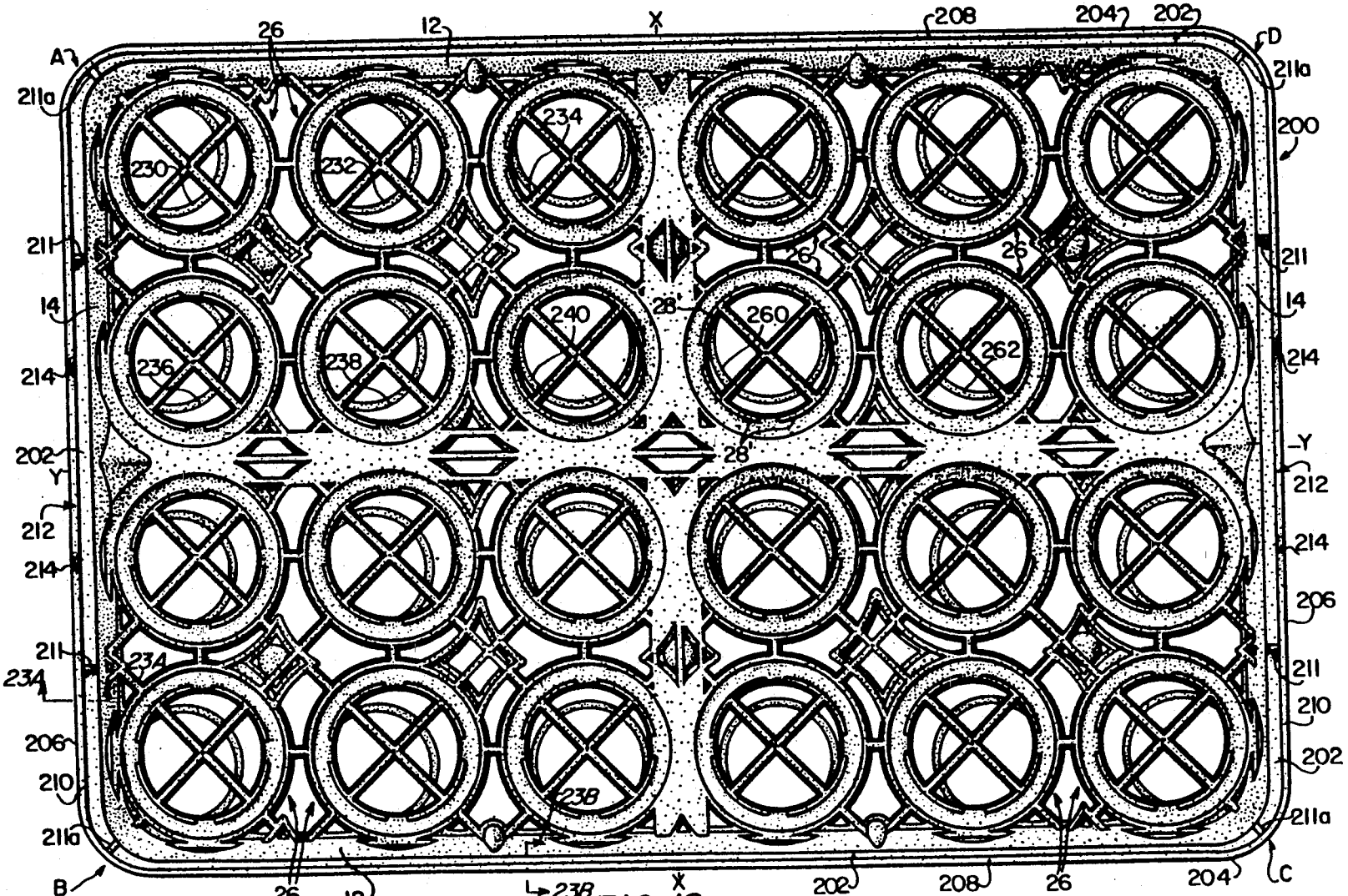
FIG. 19 is a top plan view of a second preferred and improved embodiment of a beverage can tray which includes additional features according to the present invention.
Figure 20:
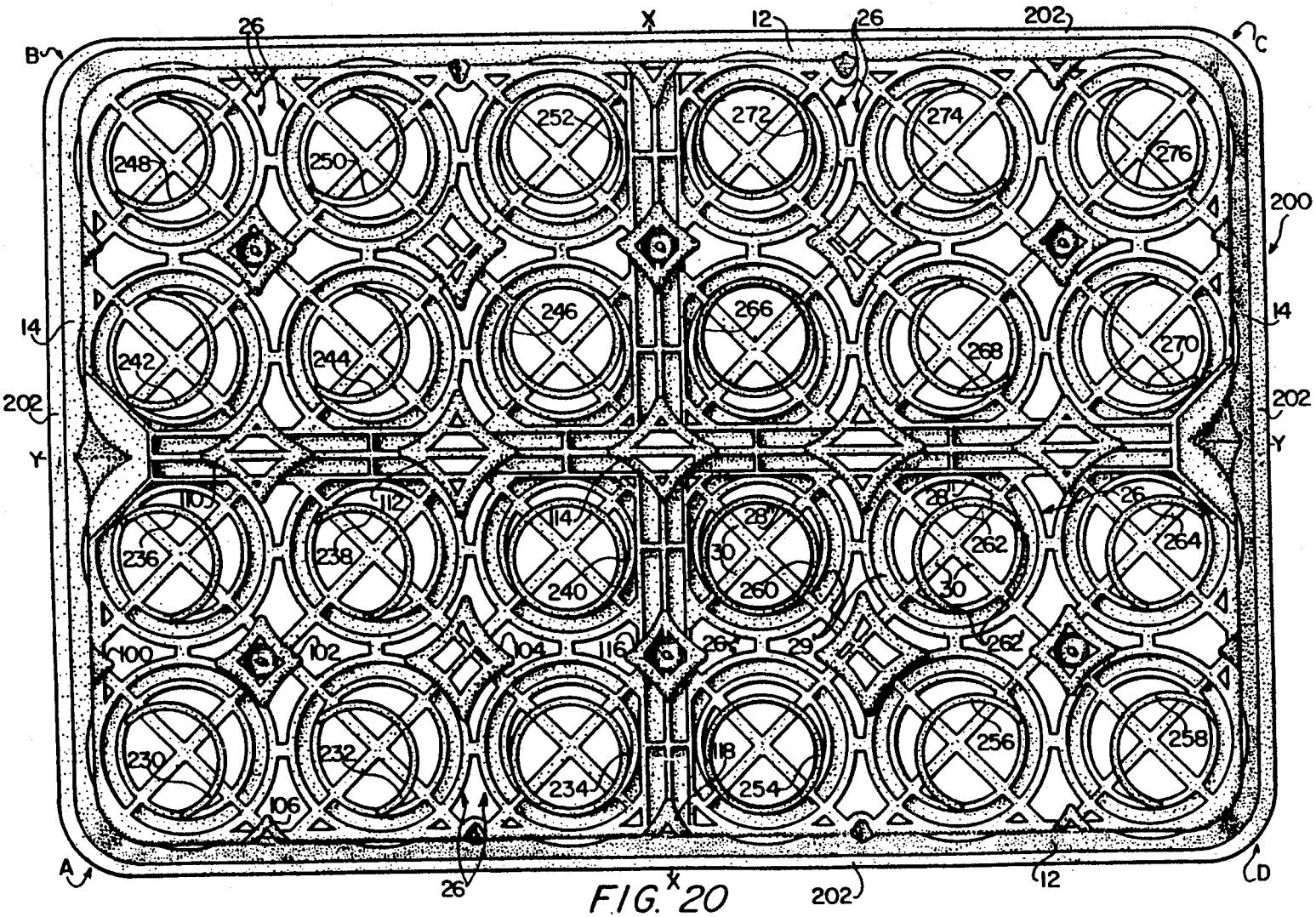
FIG. 20 is a bottom plan view of the tray of FIG. 19.

More specifically , FIGS. 19 and 20 are top and bottom plan views, respectively, of an improved second embodiment of an injection molded unitary can tray 200 according to the present invention. As is the case for tray 10 in FIGS. 1 and 2, tray 200 is divided by axes X and Y into four similar quadrants designated A, B, C and D. FIGS. 19, 20, 21, 22 and 23 show structural details differing from tray 10 in FIG. 1 which allow the empty trays 200 to be nested in a space-saving manner while permitting an easy separation of the nested trays. As previously described, tray 10 of FIGS. 1 through 4 includes a peripheral top lip 50 from which outer vertical tabs 32 and 42 protrude downwardly and whose lower edges rest on the upper surface of a subjacent tray top lip 50 when in an empty stacked array to prevent trays 10 from nesting too deeply. However, when packed can trays 10 are being handled by fork lift equipment or other means, there may be times when the thin outer vertical edge of a tray lip 50 will inadvertently contact and damage the side of a can in another tray 10 if adjacent trays 10 are at different levels when being horizontally moved. In the tray 200 embodiment, therefore, lip 50 with its associated tabs 32 and 42 are omitted and replaced by a continuous, horizontally disposed peripheral top lip 202 whose outer perimeter is vertically upturned to form upper front and rear sides 204 and upper end sides 206 which terminate in top edges 208 and 210, respectively. Front and rear walls 12 and end walls 14 of tray 200 are integrally connected at their upper edges to lip 202 which extends outwardly around the full length and width of tray 200. The relatively larger surface area of the vertical sides 204 and 206 in tray 200, as compared to the thin vertical edge area of lip 50 in tray 10, thus prevents the creasing or denting of a can in an adjacent tray 200 even if contact therewith is made by a side 204 or 206.

Figure 23A:
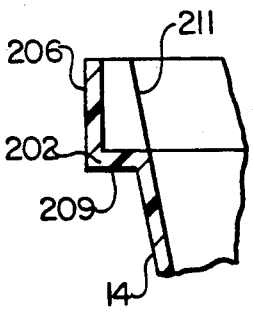
FIGS. 23A and 23B are section views taken at line 23A—23A and at line 23B—23B, respectively, in FIG. 19.
Figure 23B:
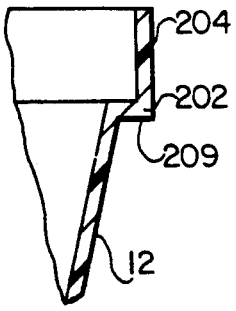

Two vertically extending ribs 211 are also provided next to the inner surface of each upper end side 206 for adding structural strength to the tray. These ribs 211 also assist in preventing the end side 206 of an upper nested tray from telescoping down inside the flexible plastic end side 206 of a lower tray, and each rib 211 is further located between an adjacent pair of can support locations 26 so that it cannot ever contact and possibly dent the side of a can. Additional vertical ribs **211*a* are also provided next to the upper sides in the inside facing corners of the tray. In addition to helping prevent the telescoping of an upper nested tray corner within a lower tray corner, these ribs 211*a* also strengthen the center portions of sides 206 and 204 against outward flexing or bowing by keeping these four sides in tension when the tray corners are forced outward by the downward pressure of upper nested trays on ribs 211*a*. Details of this lip 202 configuration are best illustrated in FIGS. 23A and 23B which are section views taken at lines 23A—23A and 23B—23B, respectively, of FIG. 19**.

Figure 24:
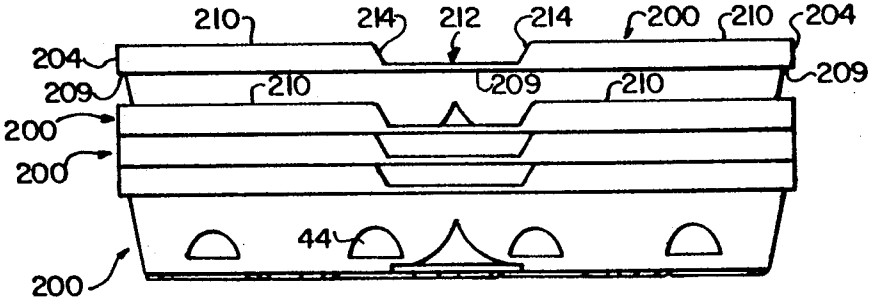
FIG. 24 is an end elevation view of a nested stack of empty trays according to the second preferred embodiment of the present invention.

When a plurality of empty trays 200 are stacked and nested as shown in FIG. 24, the horizontal outwardly extending bottom surface 209 of lip 202 rests on the top edges 208 and 210 of the subjacent tray upper sides 204 and 206 so as to prevent a tray 200 from being forced too deeply into another tray below it. But as noted in the preceding paragraph, ribs 211 and **211*a*** also assist in preventing excessive nesting.

Figure 22:
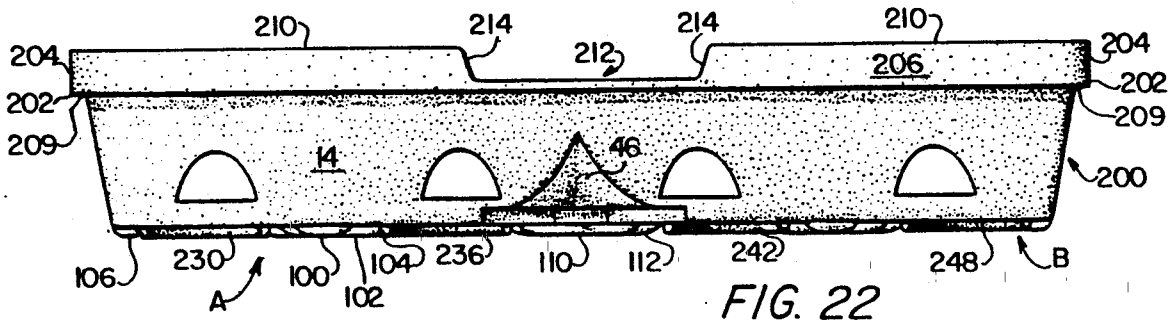
FIG. 22 is an end elevation view of the tray of FIG. 19.

Tray 200 is also provided with a horizontal elongated opening 212 in the center portion of each upper end side 206, as best shown in FIGS. 22 and 24. Each opening 212 has opposing side surfaces 214 which preferably, but not necessarily, taper inwardly from the top edge 210 and down almost to the upper horizontal surface of lip 202. Opening 212 preferably should be wide enough between its side surfaces 214, in conjunction with the height of upper end side 206 and the inner-to-outer width of lip 202, to permit one or more fingertips to be inserted therein for contacting the lower surface 209 of lip 202 of an upper nested tray 200. This allows an upper nested tray 200 to be manually lifted from the tray immediately below it in whose upper end side openings 212 the fingertips are inserted.

End side openings 212 also can be used in feeding a nested stack of empty trays 200 onto a conveyor of conventional automatic can tray packer equipment. In the can packing industry, empty plastic can trays are commonly loaded into a magazine feeder for an automatic can tray packer. The can tray packer feeds trays one at a time onto the production line infeed conveyor from the bottom of a stack in the magazine. The trays then travel through the packer and are loaded with cans filled with the product.

Figure 25:
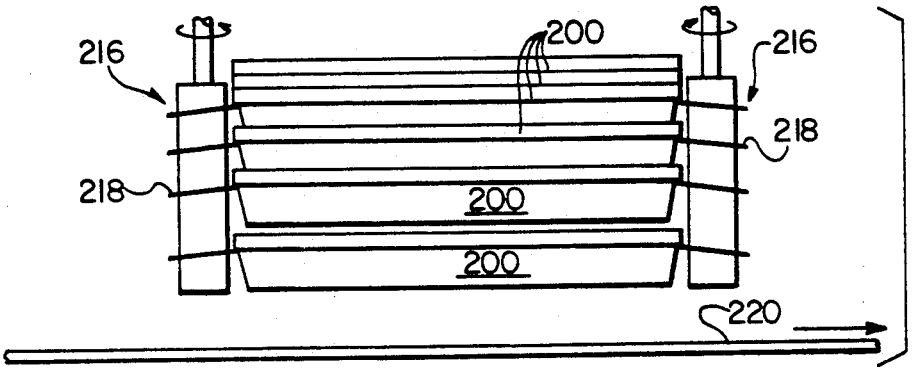
FIG. 25 is a simplified diagrammatic view of a magazine tray feeder arrangement found in or used by some automatic can tray packing equipment.
Figure 26:
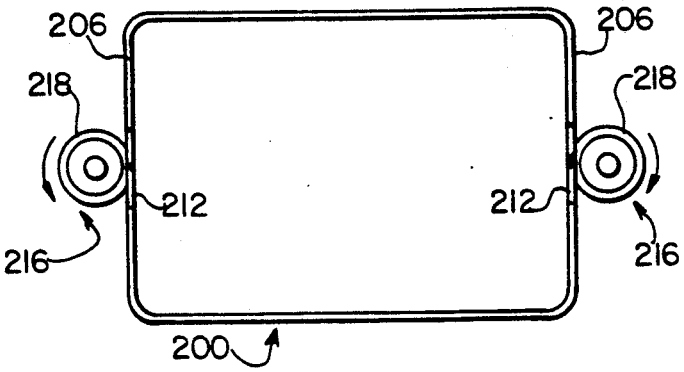
FIG. 26 is a top plan view of the arrangement shown in FIG. 25.

To move empty nested trays 200 downward from the magazine onto the conveyor, a vertically disposed destacking feed screw 216 is centered at each side of the tray magazine stack as diagrammatically illustrated in FIG. 25. FIG. 26 is a top plan view of the arrangement shown in FIG. 25. The threads 218 of each screw, whose size and spacing are not drawn to scale in FIG. 25, extend into the upper end side openings 212 of each stacked tray 200 so as to engage the lower surface 209 of lip 202 of the tray immediately above it. For this purpose when tray 200 is used with some conventional destacking screws, each opening 212 may be about 0.4" deep, 2.25" wide at its bottom, and have its opposing side surfaces 214 tapered at 5 degrees with respect to the vertical. These screw threads 218 have a constantly increasing pitch and become more widely spaced as they progress from top to bottom. Thus, as destacking screws 216 rotate, threads 218 engage the upper ends of trays 200 to lower them while gradually separating the tight nested stack of trays at the same time. When a tray 200 reaches the bottom screw thread, it drops onto a conveyor 220 and is carried to other stations for completion of the packing operation wherein trays are loaded with product-filled cans and then usually sent by conveyor to palletizing apparatus.

Figure 21:
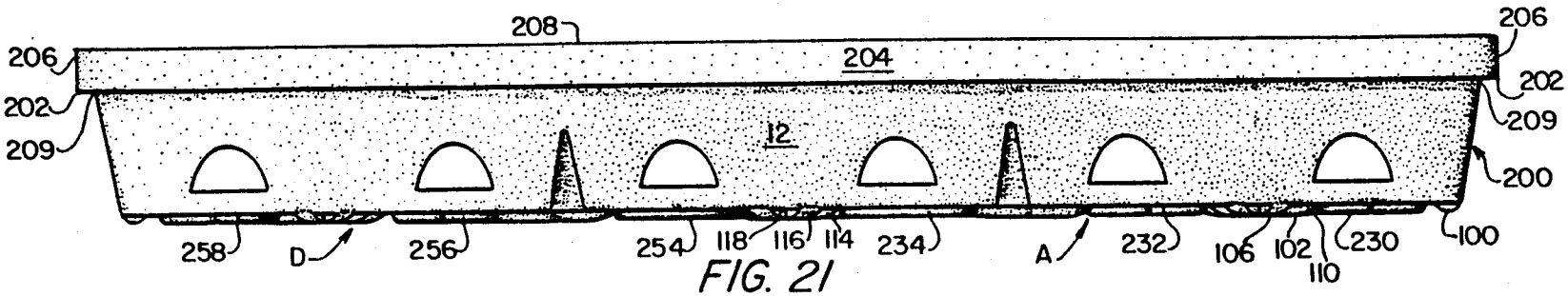
FIG. 21 is a side elevation view of the tray of FIG. 19.

As best shown in FIG. 20, the bottom exterior surface of can tray 200 also includes a plurality of twenty-four horizontally disposed arcuate rib members 230 through 276, each integrally molded to the underside of a different can support or seating location 26. For reasons later set forth, each quadrant A,B,C and D of tray 200 contains two continuous circular ribs (e.g., ribs 234 and 240 of quadrant A) and four discontinuous circular rib segments (e.g., ribs 230,232, 236 and 238 of quadrant A). Each rib member is located off center with respect to its associated can support 26. All ribs 230–276 have the same diameter which is less than the diameter of the can seat interior ring 28' (also see FIG. 30). As shown in FIGS. 21 and 22, these arcuate ribs 230–276 also extend or protrude downwardly the same distance as the interlock standoffs 100, 102, etc. of tray 200 (which were previously described in connection with can tray 10 of FIGS. 2 and 16) so that the lower or bottom surfaces of these interlock standoffs and arcuate ribs lie in the same plane.

These newly added ribs 230–276, in conjunction with standoffs 100, etc., therefore provide can tray 200 in FIG. 20 with more bottom exterior surface area in contact with a conveyor than would be provided by only the standoff bottom surface area of tray 10 in FIG. 2. This greater bottom surface area of tray 200 is very desirable because it eliminates or at least minimizes the tendency of the tray to bounce or vibrate as it is being carried by a conveyor, especially conveyors of the roller type which are often used to transport loaded trays to a palletizing station. For example, tray 10 without ribs 230–276 may exhibit a noticeable up and down pitching motion or other vibration when passing over a series of spaced rollers between which the tray's interlock standoffs are at least partially unsupported. Such motion will shake any cans on the tray which causes noise and perhaps other undesirable effects. On the other hand, tray 200 will travel over a roller conveyor in much smoother fashion because many of its ribs 230–276 will be in contact with roller surfaces when some of its interlock standoff members may not be in such contact. While the number of arcuate ribs can be fewer than the number of can supports 26 and still smooth the progress of tray 200 as compared to that of tray 10 (e.g., these ribs might only be provided beneath can supports around the periphery of the tray), spacing these ribs across the entire tray bottom and under each can support 26 is preferred and beneficial if, for example, a tray is intended to move diagonally across rollers when being rotated during the palletizing step or other operation. In any event, it is highly desirable that these ribs be provided under at least half of the can supports 26.

As will now be described, ribs 230–276 of tray 200 also are sized and located so that when a group of trays are arranged in any of the cross-tied palletized patterns shown by FIGS. 10A, 11A, 11B and 11C, the ribs 230–276 of a superior tray 200 do not contact or exert any downward force on the pressure application ends of pull tabs on can tops in any subjacent tray which, if allowed to happen, could inadvertently rupture the seal of a subjacent can top opening. These ribs 230–276 also should not rest on any subjacent pull tab pressure application ends if loaded tray 200 are column stacked with all trays in straight vertical alignment with each other, instead of being arranged in any of the FIGS. 10A, 11A, 11B or 11C patterns.

Figure 27:
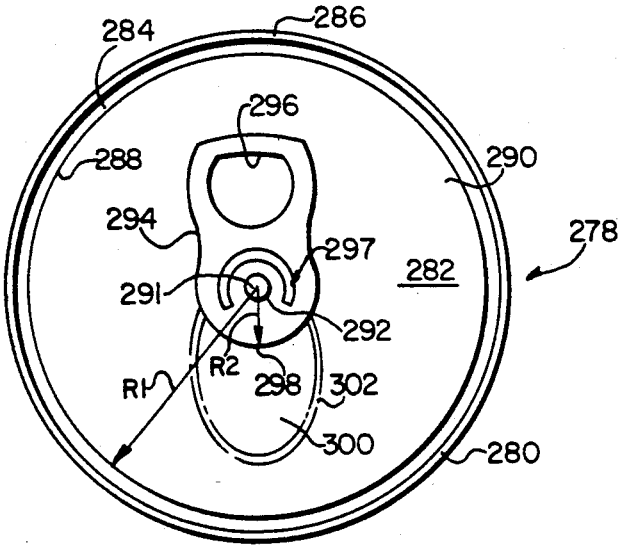
FIG. 27 is a top plan view of a typical beverage can.
Figure 28:
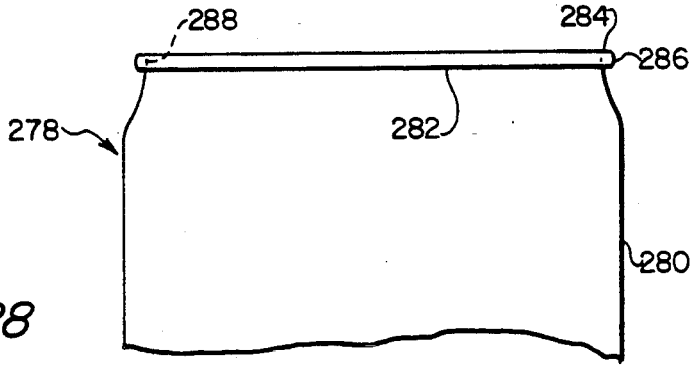
FIG. 28 is a partial side elevation view of the can shown in FIG. 27.

To further explain the foregoing criteria for the design of ribs 230–276, reference is now made to FIGS. 27 and 28 which are top plan and partial side elevation views, respectively, of a typical metal beverage can 278. Can 278 includes a cylindrical can body 280 whose top or upper end is capped by a lid 282 permanently attached thereto. Can lid 282 has a raised peripheral rim or edge 284 with an outer surface 286 and an inner surface 288. The can lid top surface 290 that lies inside rim 284 is generally flat or slightly convex when viewed from above, and its can center 291 is somewhat below the top of rim 284. The can center radius of the rim inner surface 288 is labelled "R1" in FIG. 27. A rivet 292 at the can center 291 is used to attach a generally flat, elongated pull tab member 294 to the top surface 290 of lid 282. This pull tab includes a finger hole 296 at one end thereof and a pressure application point at the opposite end 298. When this finger hole end is raised, a cutout 297 in tab 294 allows the opposite end 298 to pivot about rivet 292 and apply downward pressure to a seal member 300 in the can lid surface that covers the lid opening 302. This downward motion and pressure of tab end 298 ruptures a break line around seal member 300 and forces it down into the can interior to thereby uncover opening 302. The distance between can center 291 and tab pressure end 298 is labelled "R2" in FIG. 27.

When a superior can tray 200 is arranged in a palletized pattern or in a column stacked arrangement with respect to one or more subjacent trays, none of the ribs 230–276 should rest on the pull tab pressure application end 298 of any subjacent tray can because the downward force of a rib due to the weight of packed superior trays might also cause an inadvertent rupture of seal 300.

Figure 30:
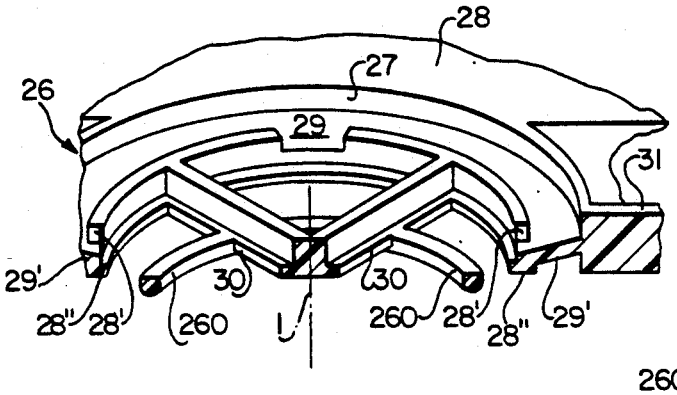
FIG. 30 is a partial top perspective section view of one of the twenty-four can support rings employed in the second preferred embodiment of the present invention.
Figure 30A:
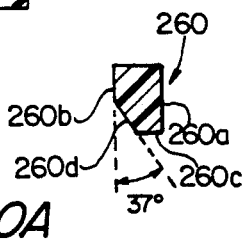
FIG. 30A is an enlarged section view of an arcuate bottom rib member taken at line 30A—30A in FIG. 30.
Figure 29B:
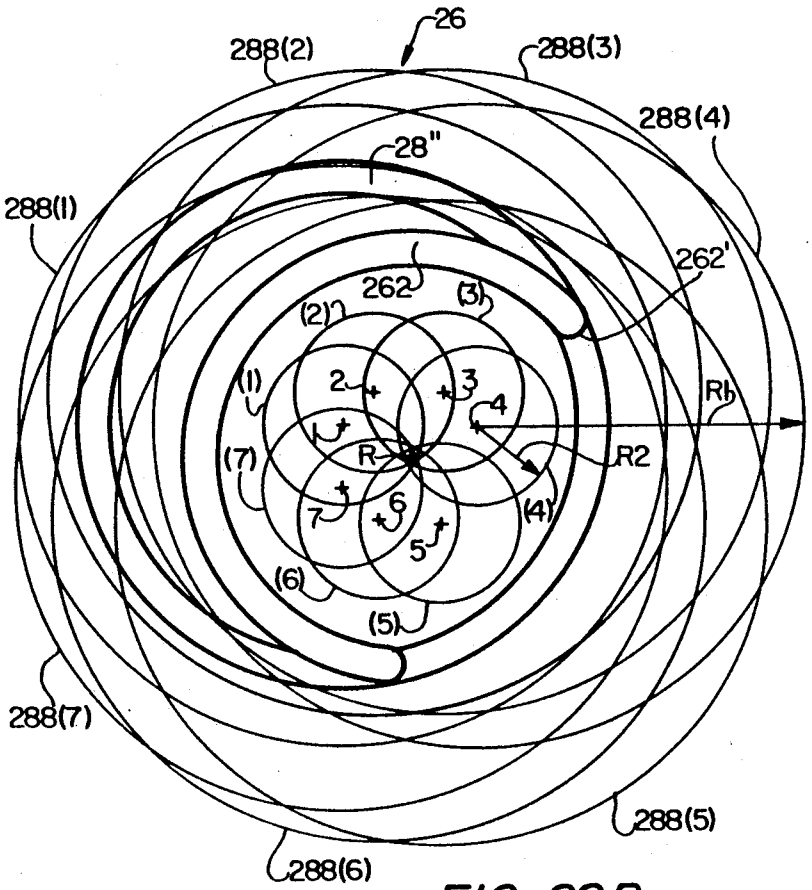
FIGS. 29A and 29B are simplified diagrammatic and exaggerated partial bottom plan views of the tray in FIG. 20.
Figure 29A:
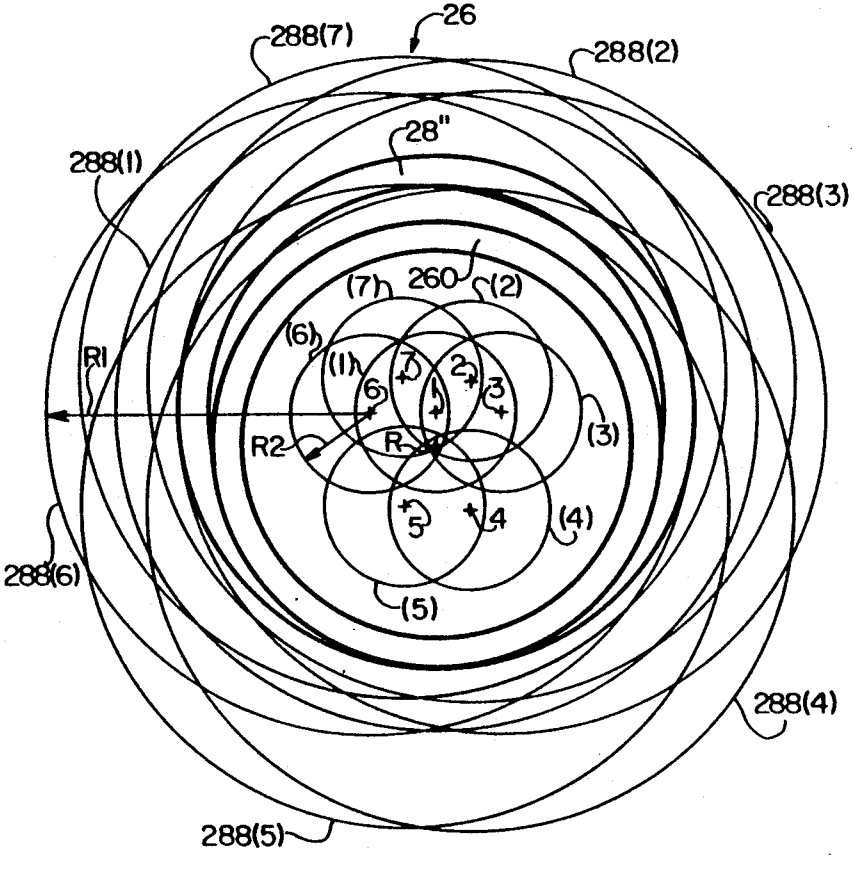

In order to properly design these ribs 230–276 so as to avoid unintended rupture of subjacent can seals, the following procedure is described in connection with FIGS. 19, 20, 27, 29A, 29B and 30. FIGS. 29A and 29B are simplified diagrammatic and enlarged partial bottom plan views of tray 200 which respectively show the continuous circular rib 260 and the discontinuous circular rib segment 262 (in heavy lines) that are associated with two can support locations 26 in quadrant D of the tray. FIG. 30 is a partial top perspective sectional view of the can support 26 to which rib 260 is molded. The center point or axis of each can support location 26 in FIGS. 29A and 29B is identified by the number "1" (also shown in FIG. 30) and is also the radius center point of the interior ring segments 28' (see FIGS. 19 and 30). Below segments 28' is the downwardly projecting inner edge wall member 28" of annular floor 29', as shown in FIGS. 20, 29A, 29B and 30. Consequently, point 1 is also the radius center of member 28". This radius center point 1, and the other radius center points 2, 3, 4, 5, 6, and 7 shown at each can support location 26 in FIGS. 29A and 29B, also denote the locations of subjacent can centers 291 (with reference to each FIG. 29 can support 26) for all possible positions and rotations of subjacent and superior trays in the various column stacked and cross-tied pallet arrangements. Radius center point numbers "1"–"7" are separately used in FIGS. 29A and 29B only as an aid in explaining the meaning of said figures and are not intended to be necessarily correlated in any specific manner to the superior-subjacent tray relationships shown in FIGS. 10B through 10G, e.g., point 2 in FIG. 29A does not necessarily indicate a subjacent can center below this can support location 26 for the superior-subjacent tray relationship of FIG. 10B.

Each of these radius center points 1–7 is also the center of a large circle 288 in FIGS. 29A and 29B having a radius "R1" and which represents the outline of the lid rim inner surface 288 of a subjacent can as shown in FIG. 27. The parenthetical number identifies the specific radius center point used in generating each circle 288. In FIGS. 29A and 29B, these radius center points 1–7 are also used to generate smaller circles of radius "R2" which are identified by a parenthetical number that indicates the specific radius center point used in generating each smaller circle. As shown in FIG. 27, radius "R2" denotes the distance between the can center 291 and the pressure application end 298 of pull tab 294. In practice, the "R1" dimension used in FIGS. 29A and 29B should be the rim inner surface radius of the smallest can lid that is expected to be on cans packed in a tray 200, while the "R2" radius is determined by the largest pull tab member expected to be on cans held by the tray.

As is now apparent from FIGS. 29A and 29B, circular rib 260 and circular rib segment 262 must be sized and located on the tray bottom exterior surface to fit entirely within each larger circle 288 that denotes the positions of the lid rim inner surfaces of subjacent cans for the various column stacked and cross-tied pallet arrangements. This is necessary because ribs 260 and 262 must not lie on the top surface of any can rim 284 but should instead extend downward from the bottom of tray 200 into the space between the can rim top surface plane and the recessed can lid surface 290. At the same time, however, each rib 260 and 262 should avoid impinging on any part of the smaller circles (1)–(7) which represent the areas wherein lie the pull tab pressure application ends 298 of the subjacent cans in a vertical column stack and for the various cross-tied pallet arrangements shown in FIGS. 10A, 11A, 11B and 11C. A radius center point "R" therefore can be located to generate a circular profile for these ribs 260 and 262 within the open area between the group of smaller circles (1)–(7) and the unobstructed interior space of the group of larger circles 288(1)–288(7). Ribs 260 and 262 thus do not overlap any circle in either of these two groups. These ribs consequently provide additional tray bottom surface area without incurring the risk of inadvertently rupturing a subjacent can seal 300 by applying downward force on its pull tab end 298, although these ribs may press down on the fingerhole ends 296 of subjacent can pull tabs which will not cause downward motion of the opposite end 298. However, to eliminate or at least minimize the possibility of a rib snagging a pull tab if a superior tray is horizontally slid off a subjacent tray, each of the ribs 230–276 is formed with a tapered inner surface at its lower end as shown, for example, by surface 260*d* of rib 260 in FIG. 30A. This tapered inner surface is preferably at a 37° angle with respect to the vertical and permits a rib to ride over a subjacent can pull tab.

Circular rib 260 is shown to be a continuous ring element that is molded to inner edge wall 28" along part of their circumferences (FIG. 20). Rib 260 is also molded to cross ribs 30 (FIG. 30), as is rib 262. However, circular rib segment 262 is a discontinuous ring element whose ends 262' are molded to, but do not extend beyond, the inner edge wall 28" in order to avoid a hot spot due to a resulting thick plastic section adjacent to the underside of annular floor 29'. Hot spots would be created if a plastic tray component has a substantially larger cross-section than other plastic tray components, because the thicker component cools more gradually in the mold. This affects shrinkage rates and would require leaving the tray in the mold for a longer period of time, thus reducing the production rate of trays.

By using the foregoing design criteria, the size and location of the other ribs 230–258 and 264–276 may be determined, thus resulting in the mirror image arrangement shown in FIG. 20 wherein each tray quadrant has two continuous arcuate ribs and four discontinuous arcuate rib segments of circular profile. However, although a circular profile for these ribs is preferred because it is the easiest shape to mold and is best for filling the space between the two groups of circles, it may be possible to form a rib in other shapes such as a series of arcs or straight sections.

When a superior can tray 200 is arranged in a palletized pattern with respect to one or more subjacent trays, there will be some subjacent tray cans whose lid rim outer surfaces 286 (FIG. 28) contact selected ones of the superior tray interlock standoffs 100, 102, etc. shown in FIGS. 16 and 20, as described above in connection with Table 1 which is also applicable to the improved tray 200 embodiment. These standoff contacts provide lateral restraint to stacked tiers of trays 200 a previously explained in connection with the first tray 10 embodiment. If a tray 200 rotates or if cans with small diameter lids are packed in trays 200, the outer vertical surfaces (e.g., see surface 260*a* in FIG. 30A) of at least some of the ribs 230–276 may also contact the lid rim inner surfaces 288 of certain subjacent tray cans, thus assisting in the lateral restraint of stacked trays. This can be another advantage of ribs 230–276 in addition to providing a larger tray bottom surface area.

Many modifications and variations of the present invention are possible considering the above teachings and specification. Therefore, within the scope of the appended claims, the invention may be practiced otherwise than as specifically described above.

What is claimed is:

1. A rectangular can tray having a front-to-rear axis and a transverse axis perpendicular to said front-to-rear axis, so that said axes divide said tray into four quadrants comprising a left front quadrant, a left rear quadrant, a right rear quadrant, and a right front quadrant, said can tray comprising:

parallel front and rear walls;

parallel end walls;

said front and rear walls and said end walls having length dimensions related by a 3:2 ratio;

a bottom portion of generally rectangular configuration and having front and rear edge from which said front and rear walls extend upwardly and end edges from which said end walls extend upwardly;

plural individual can bottom receiving means for receiving plural individual cans, said receiving means being provided in said bottom portion extending in front-to-rear rows parallel to said front-to-rear axis and in transverse rows parallel to said transverse axis;

wherein the distance between said front-to-rear edges of said bottom portion is less than the sum of the diameters of all of the cans of one of said front-to-rear rows and the distance between said end edges of said bottom portion is less than the sum of the diameters of all of the cans seatable in one of said transverse rows;

openings provided in said front and rear walls in alignment with said front-to-rear rows of said can bottom receiving means for receiving those portions of end cans in such rows which protrude beyond the front and rear edges of said bottom portion; and openings provided in said end walls in alignment with said transverse rows of said can bottom receiving means for receiving those portions of end cans in such rows which protrude beyond the end edges of said bottom portion.

2. The tray of claim 1, wherein said front, rear, and end walls are canted downwardly inwardly, and further including:

a front top lip and a rear top lip secured to and respectively parallel to said front and rear walls;

parallel end top lips secured parallel to said end walls;

plural front nesting tabs and plural rear nesting tabs secured to said front and rear top lips and extending vertically downwardly therefrom; and plural end nesting tabs secured to said end top lips and extending vertically downwardly therefrom.

3. The tray of claim 2, wherein said can bottom seating means are adapted to receive can bottoms of different diameter sizes and include plural concentric, non-co-planar can bottom seating rings, and means for connecting said rings.

4. An interlockably stackable and deeply-nestable beverage can tray comprising:

front and rear walls for containing cans within said tray;

end walls for containing cans within said tray;

said front and rear walls and said end walls having length dimensions related by a 3:2 ratio;

tray bottom means for supporting cans having an interior surface and an exterior surface;

a plurality of can seating means arranged in front-to-rear extending rows and end-to-end extending rows for receiving can bottoms and for preventing lateral movement of said can bottoms;

said front and rear walls and said end walls each having a plurality of can receiving openings aligned with said can seating means for permitting cans placed in said tray to partially extend through said openings beyond said front and rear walls and said end walls;

a plurality of downwardly extending can interlock means secured to said tray bottom exterior surface and located thereon for engaging the outer surface of top lid peripheral rims of selected cans in a subjacent can tray and for limiting lateral movement of said can top lids; and a plurality of downwardly extending bottom member means secured to said tray bottom exterior surface and located thereon to fit entirely within the top lid rims of cans in a subjacent can tray.

5. The tray of claim 4, wherein the number of said bottom member means is equal to the number of said can seating means.

6. The tray of claim 5, wherein a different one of said bottom member means is located below each said can seating means.

7. The tray of claim 4, wherein each said bottom member means comprises a horizontally disposed arcuate rib.

8. The tray of claim 7, wherein each said arcuate rib has a circular profile of smaller radius than the radius of a subjacent tray can lid rim.

9. The tray of claim 4, wherein at least one of said bottom member means comprises a horizontally disposed continuous circular rib of smaller radius than the radius of a subjacent can lid rim.

10. The tray of claim 4, wherein at least one of said bottom member means comprises a horizontally disposed discontinuous circular rib segment of smaller radius than the radius of a subjacent tray can lid rim.

11. The tray of claim 4, wherein said bottom member means extend downwardly the same distance as said can interlock means so that the lower surfaces of said interlock means and said bottom members lie in the same plane.

12. The tray of claim 4, wherein said bottom member means are also located to avoid contact with the pressure application ends of pull tabs on cans in a subjacent can tray.

13. The tray of claim 12, wherein at least one of said bottom member means comprises a horizontally disposed continuous circular rib of smaller radius than the radius of a subjacent tray can lid rim, and at least another of said bottom members comprises a horizontally disposed discontinuous circular rib segment of smaller radius than the radius of a subjacent tray can lid rim.

14. The tray of claim 13, wherein the number of said bottom member means is equal to the number of said can seating means.

15. The tray of claim 14, a different one of said bottom member means is located below and off center with respect to a different said can seating means.

16. The tray of claim 4, wherein each said bottom member means comprises a horizontally disposed rib of circular profile which is located below and off center with respect to a different said can seating means.

17. The tray of claim 16, wherein each said rib bottom member is also located to avoid contact with the pressure applications ends of pull tabs on cans in a subjacent can tray.

18. The tray of claim 17, wherein each said rib bottom member extends downwardly the same distance as said can interlock means so that the lower surfaces of said interlock means and said rib bottom members lie in the same plane.

19. The tray of claim 18, wherein each said rib bottom member includes an inner, downwardly extending surface which is tapered next to the lower surface of said bottom member.

20. The tray of claim 4, wherein said front, rear and end walls are canted downwardly and inwardly from upper edges thereof, and further including a peripheral lip secured to the upper edges of said front, rear and end walls and extending outwardly therefrom whose outer perimeter is upturned to form upper front, rear and end sides each terminating in a top edge.

21. The tray of claim 20, wherein each said upper end side has a horizontal elongated opening which extends downwardly from its said top edge.

22. The tray of claim 4, wherein said front and rear walls and end walls for containing cans within said tray are canted inwardly from top to bottom.

23. The tray of claim 22, wherein said front and rear walls and said end walls are canted at an angle of approximately 10° with respect to a plane perpendicular to said tray bottom means.

24. The tray of claim 23, wherein said can receiving openings for permitting cans placed in said tray to extend beyond said front and rear walls and said end walls comprise a plurality of contoured window cut-outs;

said cut-outs having a shape defined by an elliptical arch perpendicular to said tray bottom, and a chord thereof; and said cut-outs being spaced-apart along said front wall and said rear wall such that each of said cut-outs is aligned with a row of can seating means.

25. The tray of claim 24, wherein said tray bottom means comprises:

first molded structural channel means defining a transverse axis for said tray;

said first channel means comprising a plurality of elongated vertical ribs of rectangular cross-section having a top rib surface and a bottom rib surface;

said first channel means being perpendicularly secured at each end to one of said end walls at a point approximately midway between the ends of said end walls; second molded structural channel means defining a front-to-rear axis for said tray; said second channel means comprising a plurality of elongated vertical ribs of rectangular cross-section having a top rib surface and a bottom rib surface; and said second channel means being perpendicularly secured to said front and rear walls at a point approximately midway between the ends of said front and rear walls.

26. The tray of claim 25, wherein each of said can seating means comprises:

a tapered circular channel for nestingly receiving the bottom of a beverage can;

said circular channel being defined by a first interior ring, a second exterior ring, and a frustoconical annular floor connecting said first and second rings;

said first ring and said second ring being concentrically positioned relatively to each other on said frustoconical annular floor from which they extend upwardly;

two molded diagonal cross ribs, said cross ribs each forming a diameter of said second ring, and said cross ribs being disposed at a 45° angle with respect to said side wall means and said end wall means.

27. The tray of claim 26, wherein said tray bottom means further includes:

a plurality of ring link ribs, said link ribs being secured to said first rings; and said link ribs being disposed parallel to one or the other of said axes.

28. A rectangular can tray having a front-to-rear axis and a transverse axis perpendicular to said front-to-rear axis, so that said axes divide said tray into four quadrants comprising a left front quadrant, a left rear quadrant, a right rear quadrant, and a right front quadrant, said can tray comprising:

front and rear walls which are canted downward and inwardly from upper edges thereof;

end walls which are canted downwardly and inwardly from upper edges thereof;

a peripheral lip secured to the upper edges of said front, rear and end walls and extending outwardly therefrom whose outer perimeter is upturned to form upper front, rear and end sides each terminating in a top edge;

a bottom portion of generally rectangular configuration and having front and rear edges from which said front and rear walls extend upwardly and end edges from which said end walls extend upwardly;

plural individual can bottom receiving means for receiving plural individual cans, said receiving means being provided in said bottom portion extending in front-to-rear rows parallel to said front-to-rear axis and in transverse rows parallel to said transverse axis;

wherein the distance between said front-to-rear edges of said bottom portion is less than the sum of the diameters of all of the cans of one of said front-to-rear rows and the distance between said end edges of said bottom portion is less than the sum of the diameters of all of the cans seatable in one of said transverse rows;

openings provided in said front and rear walls in alignment with said front-to-rear rows of said can bottom receiving means for receiving those portions of end cans in such rows which protrude beyond the front and rear edges of said bottom portion; and openings provided in said end walls in alignment with said transverse rows of said can bottom receiving means for receiving those portions of end cans in such rows which protrude beyond the end edges of said bottom portion.

29. The tray of claim 28, wherein said lip horizontally extends outwardly and is vertically upturned.

30. The tray of claim 29, which further includes at least one vertically extending rib next to the inner surface of each upper end side.

31. The tray of claim 29, which further includes at least one vertically extending rib next to said upper sides in each of the inside facing corners of said tray.

32. The tray of claim 31, which further includes at least one vertically extending rib next to the inner surface of each upper end side and located between an adjacent pair of said can bottom receiving means.

33. The tray of claim 28, wherein each said upper end side has a horizontal elongated opening which extends downwardly from its said top edge.

34. The tray of claim 33, wherein each said elongated opening is horizontally centered in its respective end side.

35. The tray of claim 34, wherein each said elongated opening is partly defined by two opposing side surfaces which taper inwardly and downwardly from said upper end side top edge.

* * * * *